US005088710A

United States Patent [19]

Suzuki et al.

[11] Patent Number: 5,088,710

[45] Date of Patent: Feb. 18, 1992

[54] SORTER

[75] Inventors: Akihiro Suzuki, Ibaraki; Hiroshi Yamamoto, Mito; Hiroshi Tobita, Ohmiya, all of Japan

[73] Assignee: Ikegami Tsushinki Co., Ltd., Tokyo, Japan

[21] Appl. No.: 661,111

[22] Filed: Feb. 26, 1991

[30] Foreign Application Priority Data

Jul. 10, 1990 [JP] Japan ..... 2-180504

[51] Int. Cl.[5] ..... B65H 39/11

[52] U.S. Cl. ..... 270/53; 270/52; 271/293

[58] Field of Search ..... 270/37, 52, 53, 58; 271/292, 293, 294

[56] References Cited

U.S. PATENT DOCUMENTS

| | | | |
|---|---|---|---|
| 4,083,550 | 4/1978 | Pal | 270/53 |
| 4,878,660 | 11/1989 | Irie | 271/293 |
| 4,925,171 | 5/1990 | Kramer | 270/53 |
| 4,982,948 | 1/1991 | Burger | 271/294 |

FOREIGN PATENT DOCUMENTS

| | | | |
|---|---|---|---|
| 46866 | 2/1987 | Japan | 271/293 |
| 62-269852 | 11/1987 | Japan . | |
| 63-12564 | 1/1988 | Japan . | |
| 63-51191 | 3/1988 | Japan . | |
| 63-59591 | 3/1988 | Japan . | |
| 66069 | 3/1988 | Japan | 271/293 |
| 63-109448 | 5/1988 | Japan . | |
| 63-109449 | 5/1988 | Japan . | |
| 63-180673 | 7/1988 | Japan . | |
| 63-252872 | 10/1988 | Japan . | |
| 295371 | 12/1988 | Japan | 270/53 |
| 64-17765 | 1/1989 | Japan . | |
| 64-34864 | 2/1989 | Japan . | |
| 64-34869 | 2/1989 | Japan . | |
| 64-43456 | 2/1989 | Japan . | |
| 64-43457 | 2/1989 | Japan . | |
| 1-229601 | 9/1989 | Japan . | |
| 1-231757 | 9/1989 | Japan . | |
| 1-236163 | 9/1989 | Japan . | |
| 23158 | 1/1990 | Japan | 270/53 |

*Primary Examiner*—Edward K. Look
*Assistant Examiner*—Therese M. Newholm
*Attorney, Agent, or Firm*—Oliff & Berridge

[57] ABSTRACT

A sorter with a plurality of receptacles arranged vertically movably and being capable of receiving articles to be treated. A drawing mechanism sequentially draws out one of the receptacles to a predetermined treatment position by shifting the receptacles. A treatment is applied by a treatment mechanism to the articles on respective receptacles drawn out to the treatment position. One of the articles is discharged by a discharging mechanism to a lower adjacent receptacle positioned just below the receptacle drawn out. A front portion of each receptacle is guided diagonally upwardly by a guiding mechanism when the receptacle is drawn out, the front portion of the receptacle being remote from the treatment position.

10 Claims, 26 Drawing Sheets

SORTER

BACKGROUND OF THE INVENTION

1. Field of the Invention

The present invention relates to a sorter which stacks articles to be treated on receptacles, such as trays, during sorting, and then applies a treatment, such as stapling or bonding, to the articles. The article to be treated may include, for example, sheets discharged from photocopiers, printers or the like.

2. Description of the Prior Art

Generally, a sorter of this type, such as a sorter with a stapler, is provided with vertically movable trays. The trays are sequentially shifted to be placed in an open state for receiving a sheet. Sheets are stacked on tray bins in the open state in a sorted manner by discharging the sheets to them. After stacking of sheets are completed, the sheets on respective trays are stapled with the stapler.

To place each tray in the open state, such a conventional sorter is provided with a mechanism for vertically moving a tray away at one side thereof from an upper adjacent tray. In this manner, the sorter is capable of receiving a sheet in the tray from the moved away side without being prevented by the upper adjacent tray.

In conventional sorters, the tray to which a sheet is discharged is however not sufficiently moved away at the opposite sides thereof form the adjacent upper tray.

For this reason, it is not possible to provide sufficiently large sheet accommodation space to a tray when a sheet is discharged into the tray. Particularly, when a large amount of sheets are stacked, they are not smoothly received in trays. There is the same problem in a sorter with article receptacles which are operated in a fashion similar to such trays.

SUMMARY OF THE INVENTION

Accordingly, it is an object of the present invention to provide a sorter which is capable of sufficiently enlarging an accommodation space of each receptacle, when an article to be treated, such as a sheet is discharged into the accommodation space of the receptacle.

In view of this and other objects, the present invention provides a sorter which comprises:

a plurality of receptacles arranged vertically movably and being capable of receiving articles to be treated;

means for sequentially shifting and drawing out each of the receptacles to a predetermined treatment position, the receptacles each having a front portion remote from the treatment position;

means for applying predetermined treatments to the articles on respective receptacles drawn out to the treatment position;

means for discharging one of the articles to a lower adjacent receptacle positioned just below the receptacle drawn out; and means for guiding the front portion of each receptacle diagonally upwardly when the receptacle is drawn out.

Here, the guide means may comprise: a pin mounted to the front portion of each receptacle; and a guide groove substantially V-shaped for slidably guiding the pin.

A sorter may further comprise a receptacle carrier, arranged vertically movably, for carrying the plurality of receptacles.

The guide means may comprise: a pin provided to the front portion of each receptacle; and guide groove, which is substantially V-shaped and provided to the receptacle carrier, for slidably guiding the pin.

Each of the receptacles may be a tray for receiving sheets as articles to be treated.

A sorter may further comprise a tray carrier, arranged vertically movably, for carrying the trays therein.

The guide means may comprise: a pin provided to the front portion of each tray; and guide groove substantially V-shaped, provided to the tray carrier, for slidably guiding the pin.

The treatment applying means may comprise a stapler for stapling the articles to be treated.

A sorter may further comprise a vertically movable tray carrier for carrying the trays therein.

The guide means may comprise: a pin provided to the front portion of each tray; and guide groove substantially V-shaped, provided to the tray carrier, for slidably guiding the pin.

In the sorter according to the present invention, the front portion of a receptacle is diagonally upwardly guided by the guide means when the receptacle is drawn out to the diagonally upward treatment position. The receptacle is positioned just above a receptacle into which an article to be treated is discharged. The article accommodation space in each of the receptacles is thus sufficiently enlarged when an article is discharged to the receptacle, and thereby the receiving of each article in the corresponding receptacle is positively achieved even in the case where a large amount of articles are stacked on the receptacles.

The above and other objects, effects, features and advantages of the present invention will become more apparent from the following description of embodiments thereof taken in conjunction with the accompanying drawings.

DETAILED DESCRIPTION OF PREFERRED EMBODIMENTS

A sorter of the present invention will be described with reference to FIGS. 1 to 25. The sorter deals with sheets as articles to be treated and is provided with a stapler. Before describing the construction of the sorter in detail, it will be generally described with reference to FIGS. 1 to 3.

Figure 1:
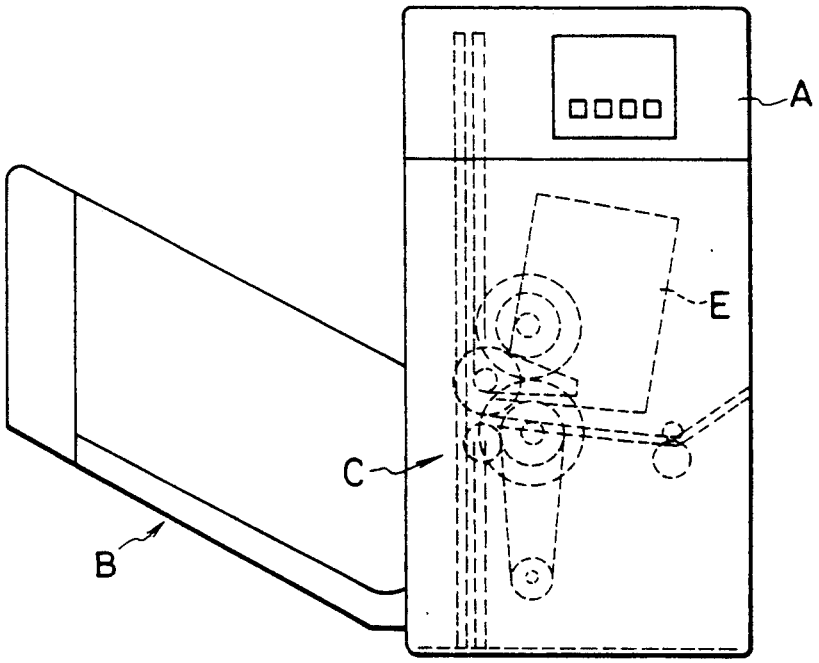
FIG. 1 is a diagrammatic side view of a sorter of the present invention.
Figure 2:
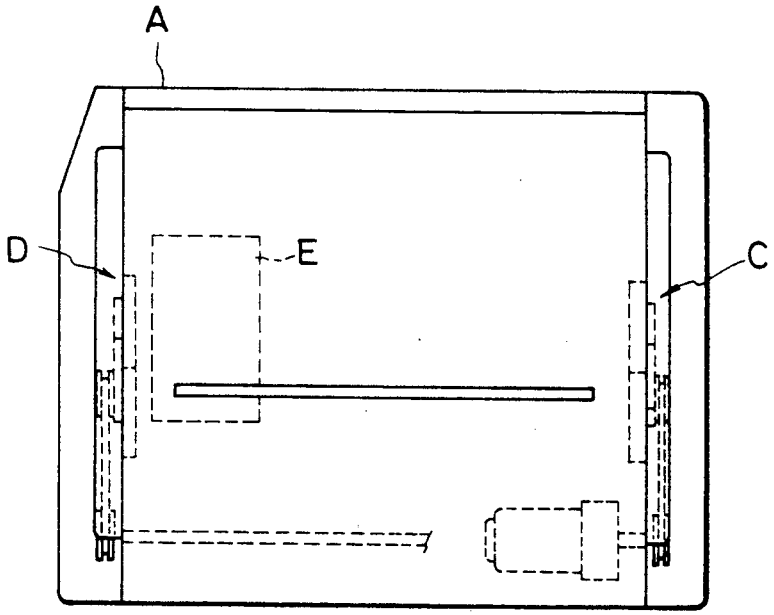
FIG. 2 is a diagrammatic front view of the sorter of FIG. 1.
Figure 3:
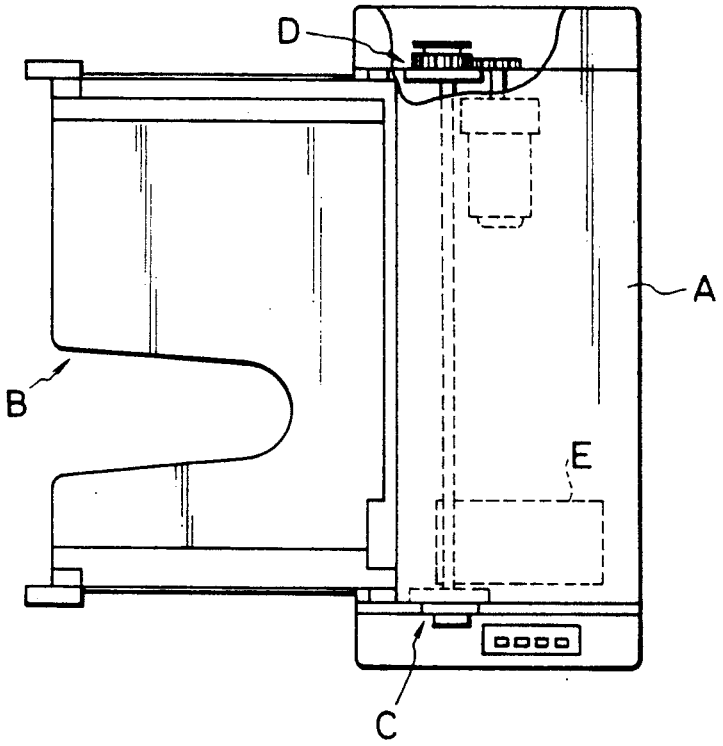
FIG. 3 is a diagrammatic plan view of the sorter of FIG. 1.

In FIGS. 1 to 3, the reference character A designates casing body, and B a tray unit including a plurality of trays projecting from the casing body A. Each tray of the tray section B is arranged to be vertically movable. Reference character C and D each indicates a Geneva wheel mechanism which includes a pair of Geneva wheels. The Geneva wheel mechanisms sequentially shift the plurality of trays and hold the trays in an open state in which the tray is capable of receiving a sheet. The reference character E designates a stapler provided within the casing body A.

A detailed construction of the sorter will be described with reference to FIG. 4, in which forward, rearward, rightward, and leftward directions are indicated by arrows FR, RR, RH and LH for facilitating understanding of the invention.

Body Casing A

Figure 4:
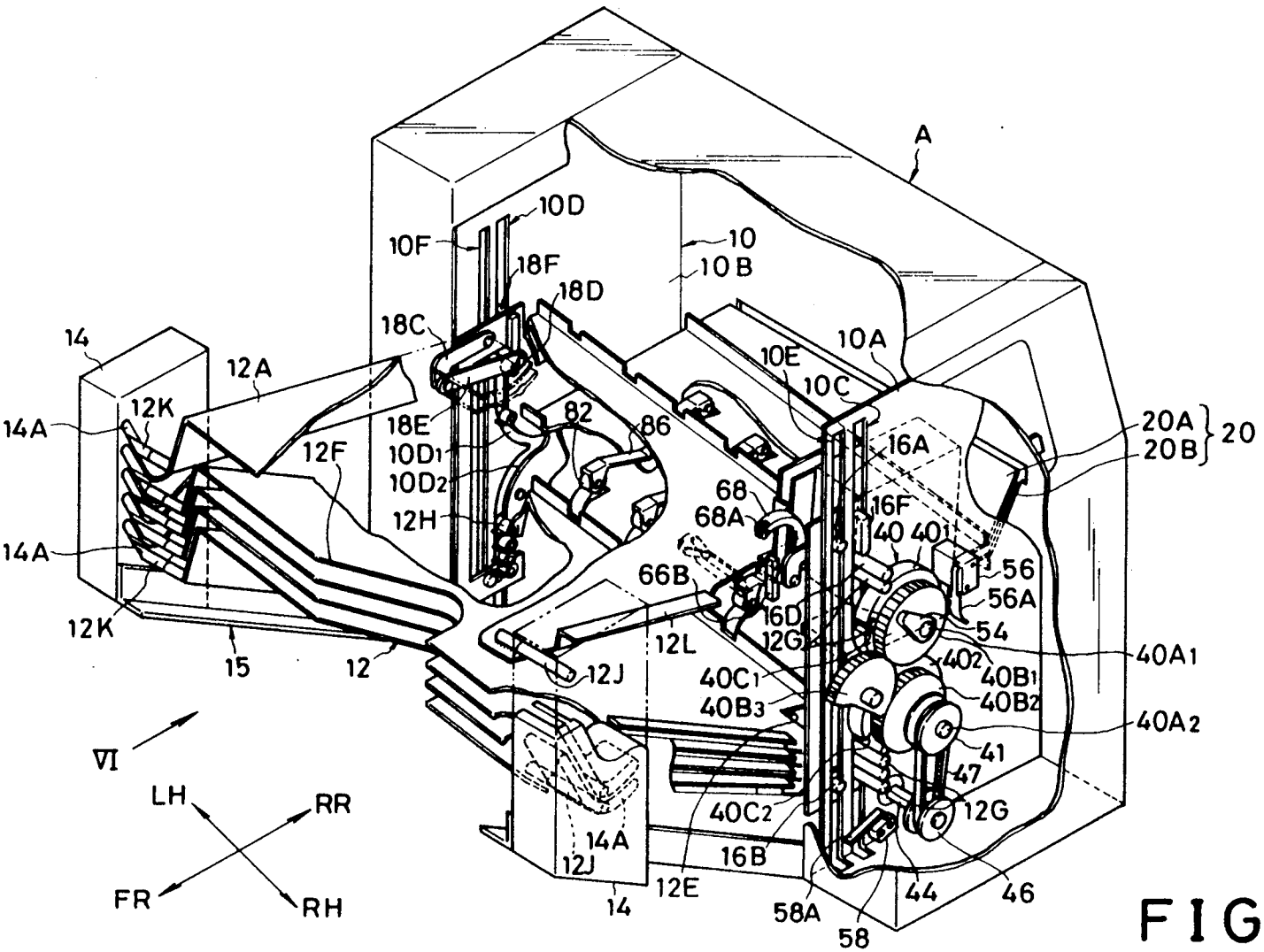
FIG. 4 is an enlarged perspective view, partly cut away, of the sorter of FIG. 1.

In FIG. 4, reference numeral 10 designates a main frame accommodated in the casing body A. The main frame 10 includes a right side frame 10A and a left side frame 10B which are vertically erected in parallel with the opposite sides of the casing body A. Each of the side frames 10A and 10B is provided with first slots 10C and 10D for guiding trays, respectively. The side frames 10A and 10B are further provided with second slots 10E and 10F for guiding tray carriers, respectively. The tray carriers will be described hereinafter. The first slots 10C and 10D have vertical opposite end portions and arcuate portions $10C_1$, $10C_2$ and $10D_1$, $10D_2$ formed to be continuous to the vertical opposite end portions, respectively (FIG. 4 and FIGS. 21(A) to 21(E). The arcuate portions $10C_1$, $10C_2$ and $10D_1$, $10D_2$ are formed to correspond to radius of Geneva wheels which will be described hereinafter. On the other hand, the second slots 10E and 10F extend vertically.

Tray Section B

Figure 8:
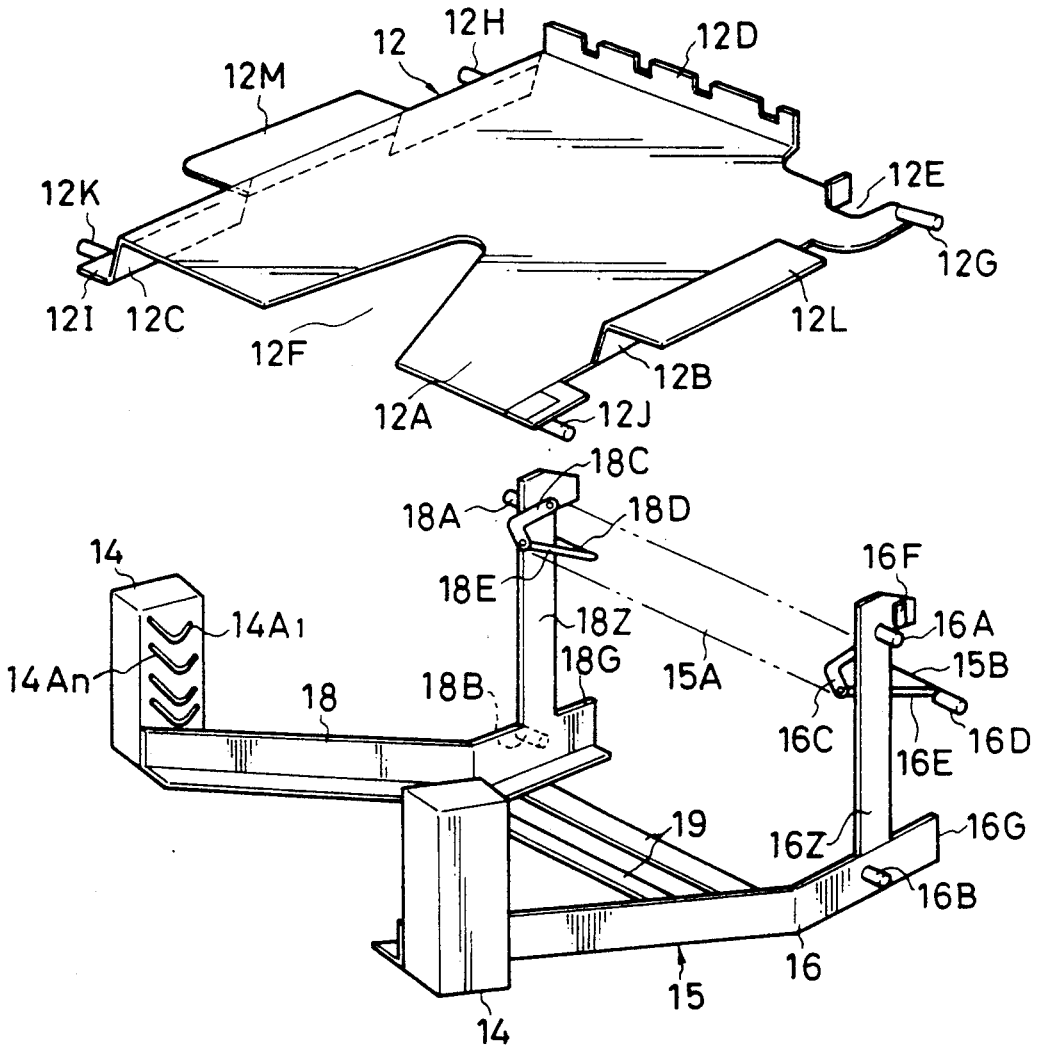
FIG. 8 is a perspective view of one of the trays and the tray carrier of FIG. 4 on a reduced scale.
Figures 9, 10:
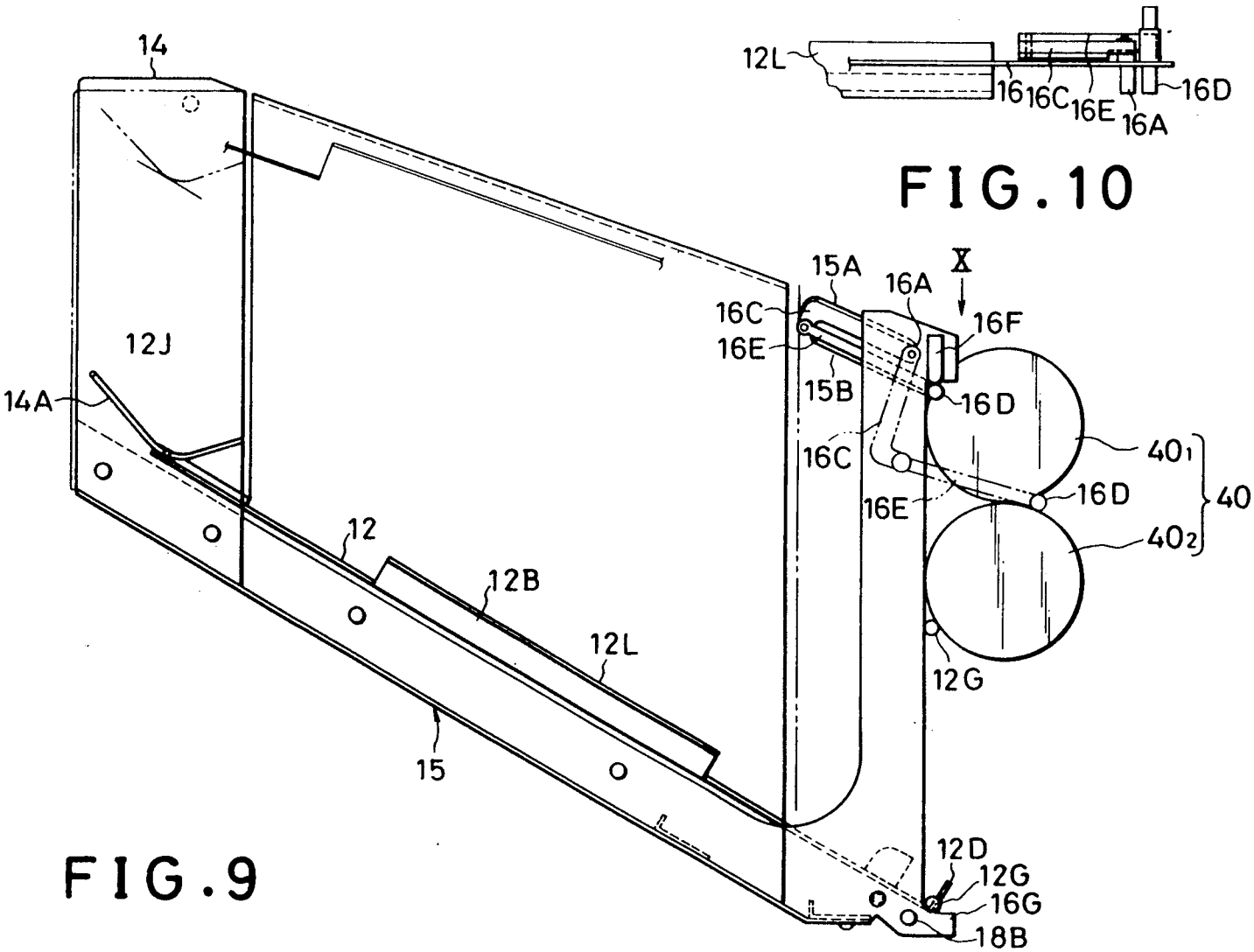
FIG. 9 is a side view of the tray carrier of FIG. 4.
FIG. 10 is a fragmentary view as viewed in the direction of arrow X in FIG. 9.

The tray section B includes a plurality of trays $12_1$ to $12_n$ vertically arranged in a tray carrier 15. As shown in FIG. 8, each of the trays $12_1$ to $12_n$ is integrally provided with a right side wall 12B extending upwardly at the right angle with a bottom wall 12A on the right side, a rear side wall 12D extending upwardly at the right angle with the bottom wall 12A on the rear side and a left side wall 12C extending downwardly at the right angle with the bottom wall 12A on the left side, the left side wall 12C having a height larger than the right side wall 12B.

By providing the upward side wall 12B and the downward side wall 12C to each of the trays $12_1$-$12_n$, the tray is increased in vertical section modulus, thereby being enhanced in strength. The trays $12_1$-$12_n$ may be thus reduced in thickness.

Each of the trays $12_1$-$12_n$ is provided at the rear right corner thereof with a cutout 12E for stapling operation for sheets which will be described hereinafter. Each tray is further provided at a front portion thereof with a cutout 12F for facilitating taking out sheets.

Imaginary extension lines of the right side wall 12B and the rear side wall 12D perpendicularly intersect at the cutout 12E.

In each tray, on the rear right side of the bottom wall 12A and the rear side of the left side wall 12C are respectively provided with horizontal rear tray pins 12G and 12H, which are vertically movably fitted into corresponding through slots 10C and 10D. Front tray pins 12J and 12K are provided on the front right side of the bottom wall 12A and the front side of a horizontal wall 12I which extends from the lower edge of the left side wall 12C of each tray, respectively, to horizontally project. The front tray pins 12J and 12K are slidably engaged with corresponding front guide members 14, which will be described later. Reference characters 12L and 12M designate safety plates which respectively extend from the right side wall 12B and left side wall 12C horizontally outwardly so that an operator may not put his fingers or hand between stacked trays $12_1$-$12_n$ carelessly.

Holding Mechanism of the Tray Section B

The trays $12_1$-$12_n$ are held within a tray carrier 15, shown in FIG. 8, in a stacked fashion. The tray carrier 15 has a pair of substantially L-shaped carrier side frames 16 and 18 interconnected with stays 19 so that the carrier side frames 16 and 18 are horizontally spaced. The carrier side frames 16 and 18 are respectively provided at rear portions thereof with a pair of vertically arranged guide pins 16A, 16B and guide pins 18A, 18B, which are vertically slidably guided in respective second slots 10E and 10F of the casing body A.

The carrier side frames 16 and 18 are respectively provided at the front end thereof with front guide members 14 and 14 so that the front guide members 14 and 14 are symmetrical about the center line of the tray carrier 15. The front guide members 14 and 14 have substantially V-shaped guide grooves $14A_1$-$14A_n$ formed in oppositing surfaces thereof in a number corresponding to the number of the trays $12_1$-$12_n$ although the guide grooves $14A_1$-$14A_n$ of the right side guide member 14 are not shown in FIG. 8. The front tray pin 12J and 12K of each of the trays $12_1$-$12_n$ are slidably fitted into corresponding guide grooves $14A_1$-$14A_n$.

The carrier side frames 16 and 18 have vertical poles 16Z and 18Z integrally formed with rear ends thereof, respectively. The vertical poles 16Z and 18Z are provided at respective upper end portions thereof with pivotal first links 16C and 18C, to which pivotably connected are second links 16E and 18E having dummy pins 16D and 18D, respectively. The dummy pins 16D and 18D are vertically slidably fitted into respective first slots 10C and 10D of the main frame 10 as well as the rear tray pins 12G and 12H so that the dummy pins 16D and 18D are located above the rear tray pins 12G and 12H. An upper safety cover 15A is extended between the first links 16C and 18C whilst a lower safety cover 15B between the second links 16E and 18E. The upper safety cover 15A and the lower safety cover 15B prevent a hand of an operator from being placed in the devices.

Resist pins 16F and 18F are provided to upper ends of the vertical poles 16Z and 18Z to be adjustable in vertical position, respectively. The resist pins 16F and 18F are mounted to the vertical poles 16Z and 18Z so that they are vertically movably fitted into the first slots 10C and 10D of the main frame 10 and may be urged against the dummy pins 16D and 18D, respectively. In this manner, the rear tray pins 12G and 12H of the trays $12_1$-$12_n$ and the dummy pins 16D and 18D are inserted into respective first slots 10C and 10D in such a fashion as to be strongly tightly held between the rear ends 16G and 18G and the resist pins 16F and 18F of the side frames 16 and 18, respectively.

Sheet Transporting Mechanism in the Casing Body A

In the casing body A, there is provided a sheet transporting mechanism which transports a sheet, discharged from a copying machine or the like, onto the trays $12_1$-$12_n$.

Figure 5:
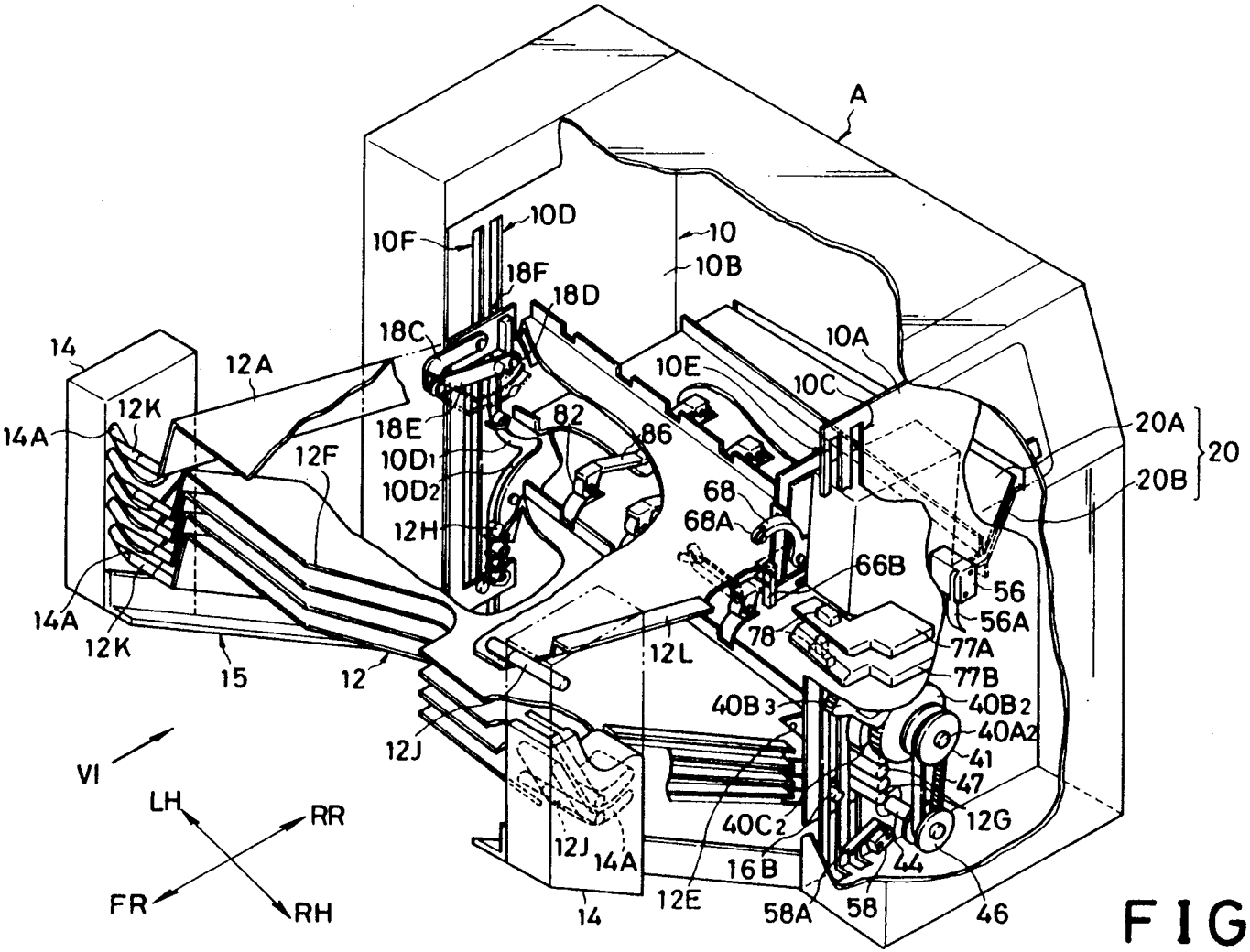
FIG. 5 is a perspective view, partly further cut away, of the sorter of FIG. 4.

In FIG. 5, 20 indicates a transporting guide which is composed of a pair of guide plates 20A and 20B mounted to a main frame 10 to arrange the guide plate 20A above the guide plate 20B. The transporting guide 20 is arranged so that an entrance portion thereof is positioned at a sheet discharge opening of a copying machine not shown. The transporting guide 20 is provided at an outlet portion thereof with a sheet putting aside mechanism shown in FIG. 11.

Figure 12:
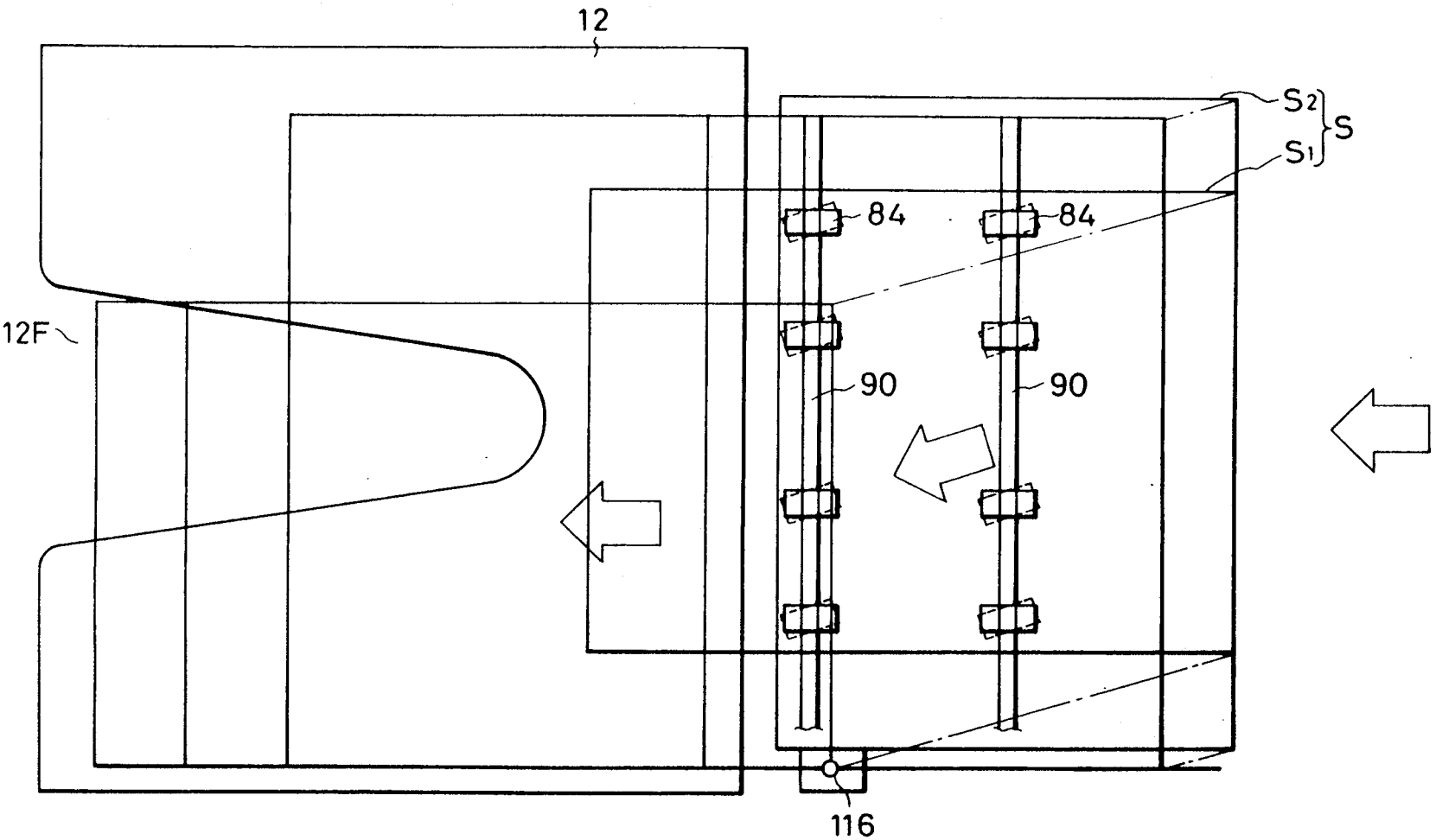
FIG. 12 is an enlarged diagrammatic plan view of the sheet putting aside mechanism shown in FIG. 4.

The sheet putting aside mechanism has an upper guide plate 80A having a plurality of pinch rollers 82 mounted on it. The sheet putting aside mechanism is further provided with a lower guide plate 80B. The mechanism brings a sheet S ($S_1$ or $S_2$) downward in FIG. 12 while transporting the sheets S between the pinch rollers 82 and feed rollers 84 located on the side of the lower guide plate 80B. In FIG. 12, the sheet $S_1$ is a $A_4$ size sheet arranged along the transporting direction shown by the arrows while the sheet $S_2$ a $A_4$ size sheet arranged crosswise.

The pinch rollers 82 are rotatably mounted to the upper guide plate 80A through corresponding leaf springs 86. Each of the feed rollers 84 is mounted to a corresponding one of two roller shafts 90 through a pivot roller 88. The roller shafts 90 are rotatably supported on a right side plate 92A and a left side plate 92B of a case 92. The pivot roller 88 is a spherical joint constituting a constant velocity joint which enables to transmit the rotation of the roller shaft 90 to the corresponding feed roller 84, and which makes the axial direction of each feed roller 84 variable.

The case 92 includes an upper plate 92C, which has first links 96A and 96B angularly movably supported at opposite ends thereof by means of vertical pins 94A and 94B, respectively. The first links 96A and 96B are spring biased at intermediate portions thereof by springs 98A and 98B not to move upwardly, respectively. The opposite free ends of each of the first links 96A, 96B are connected to corresponding second links 100A and 100B.

As shown in FIGS. 11 and 13-15, the second links 100A and 100B engage with corresponding resilient arms 102A which are mounted on roller guides 102 provided to correspond in number to the feed rollers 84. Each roller guide 102 is rotatably supported at a supporting shaft 102B thereof on the upper plate 92C of the case 92, and is angularly moved in accordance with lateral movement of the corresponding second link 100A, 100B which movement is transmitted through the corresponding arm 102A. Each roller guide 102 is provided with a roller restrainer 102C substantially in the shape of U as viewed in FIG. 14. The roller restrainers 102C surround the opposite surfaces of corresponding feed rollers 84 not to prevent rotation thereof. Each roller guide 102 changes the direction of the corresponding feed roller 84 according to the rotational angle thereof. The roller guides 102 each has a guide arm 102D horizontally projecting from them. Each guide arm 102D is provided at a distal end thereof with a guide pin 102E, which is guided in a corresponding guide groove 92D formed through the upper plate 92C of the case 92. With this guide mechanism, the corresponding roller guide 102 is restricted in rotational angle range. In this embodiment, each of the roller guides 102 are limited in rotational angle range so that the corresponding feed roller 84 is allowed to angularly move 15° between the position, indicated by the solid line, and the position by the dot-and-dash line in FIG. 12.

Figure 13:
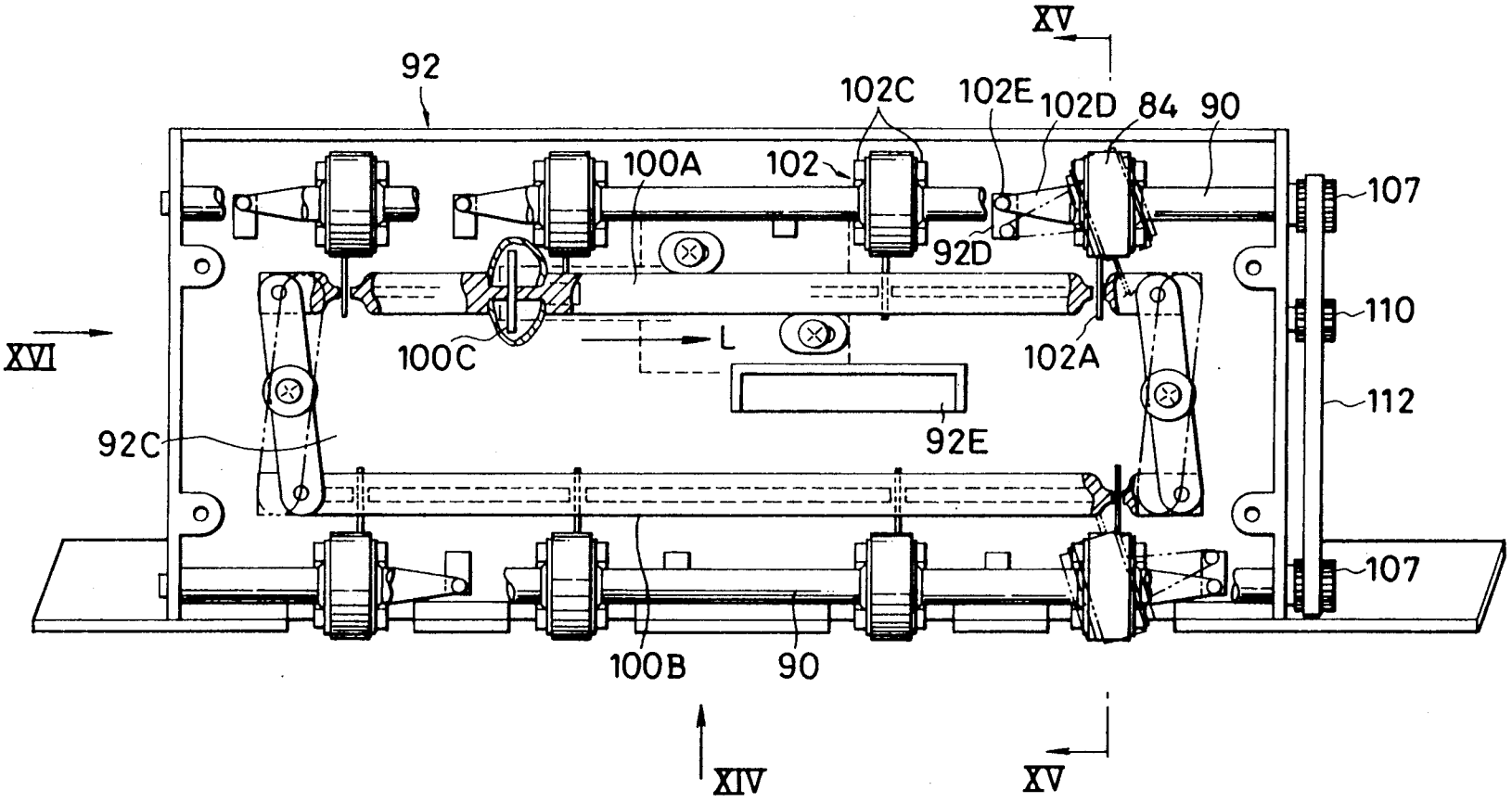
FIG. 13 is an enlarged plan view of the feed roller drive unit of the sheet putting aside mechanism shown in FIG. 4.
Figure 14:
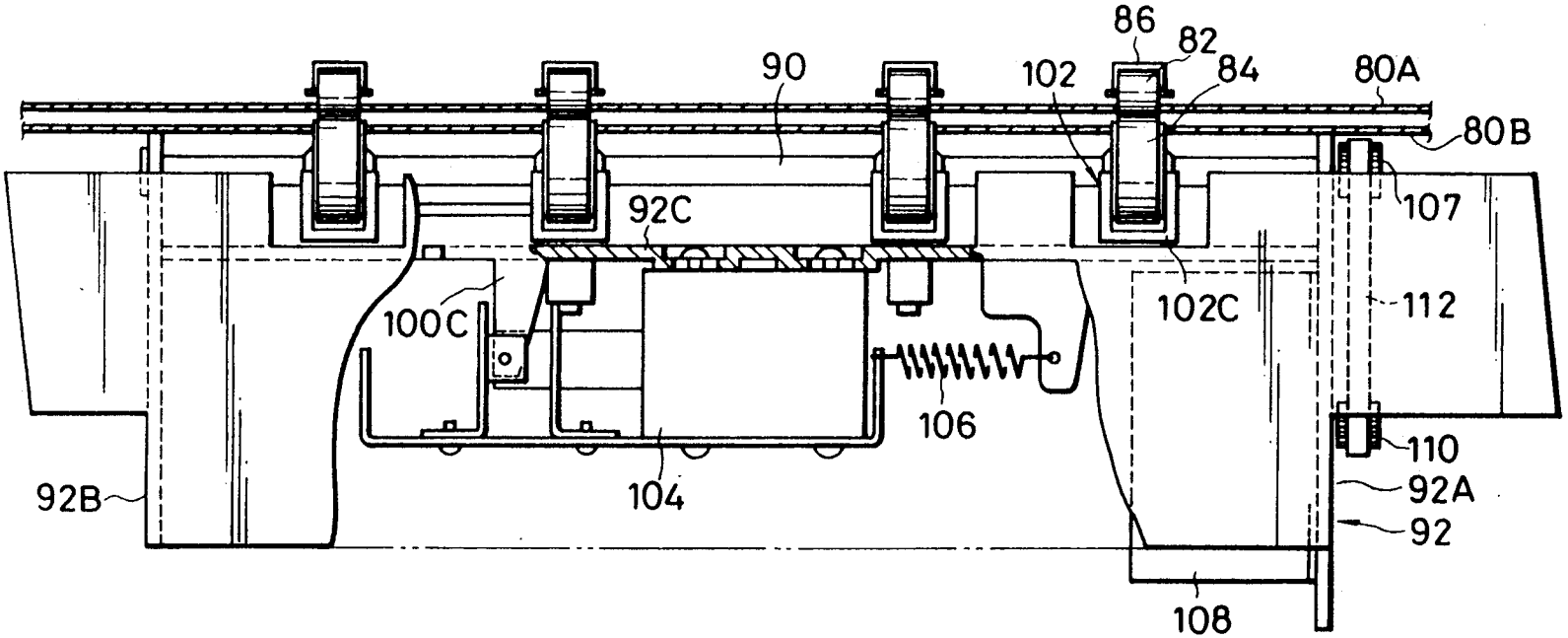
FIG. 14 is a view partly cut away and viewed in the direction of arrow XIV in FIG. 13.

As shown in FIGS. 13 and 14, the second link 100A is connected to an solenoid 104 through a slide arm 100C, which downwardly passes through the upper plate 92C of the case 92. The second link 100A is also connected to a return spring 106. The second link 100A is moved by the actuation of the solenoid 104 in one lateral direction shown by arrow L in FIG. 13 and by the restoring force of a spring 106 in the direction opposite to arrow L. Each of the roller shafts 90 has a driven pulley 107 mounted on a right hand end thereof. A timing belt 112 is extended around the driven pulleys 107 and a drive pulley 110 of a transporting motor 108 which is mounted on the side plate 92A of the case 92. The two roller shafts 90 are thus rotated in a direction to transport sheets in the sheet transporting direction shown by arrows in FIG. 12.

Figure 11:
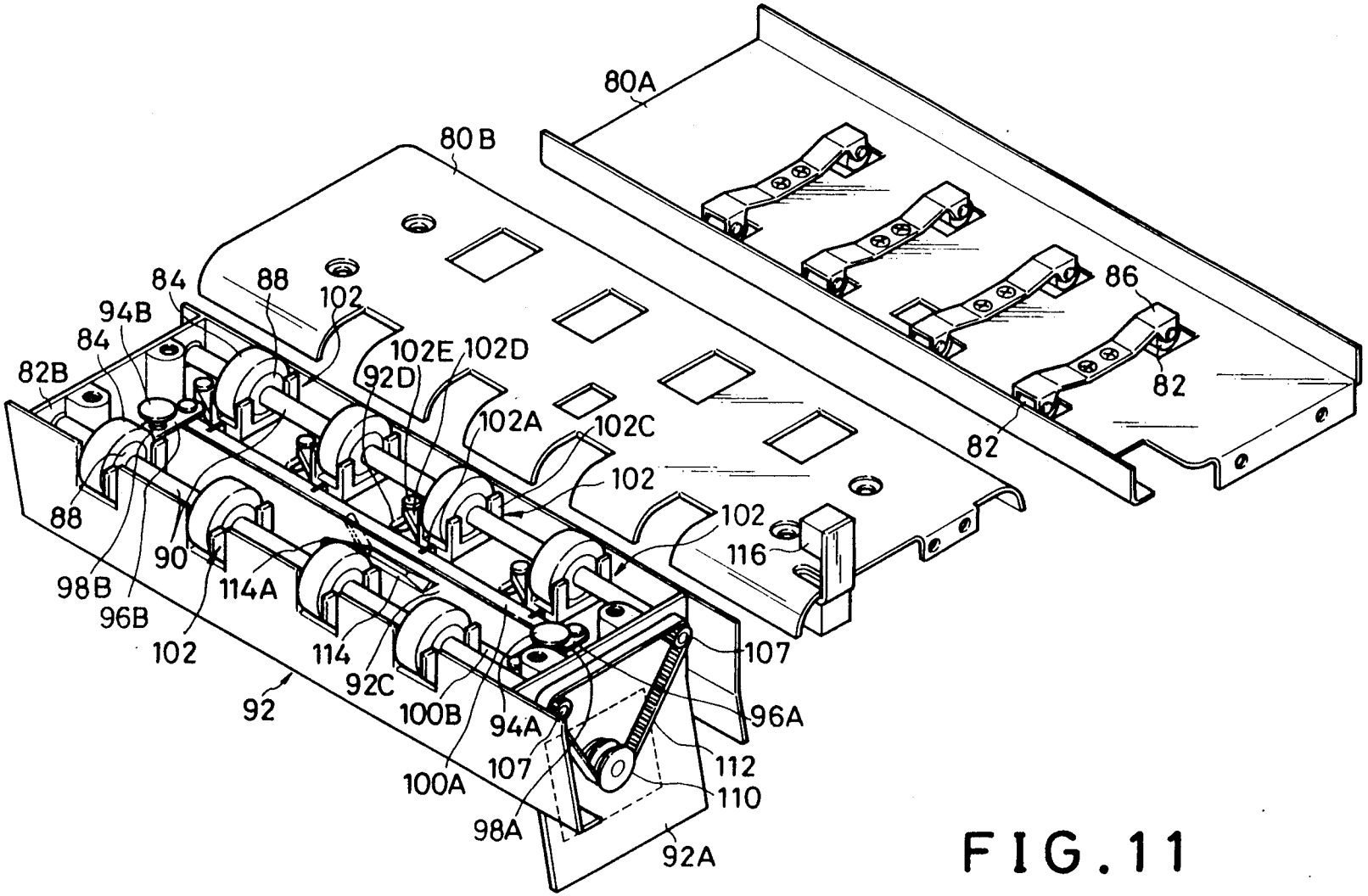
FIG. 11 is an enlarged exploded view of the sheet putting aside mechanism shown in FIG. 4.
Figure 15:
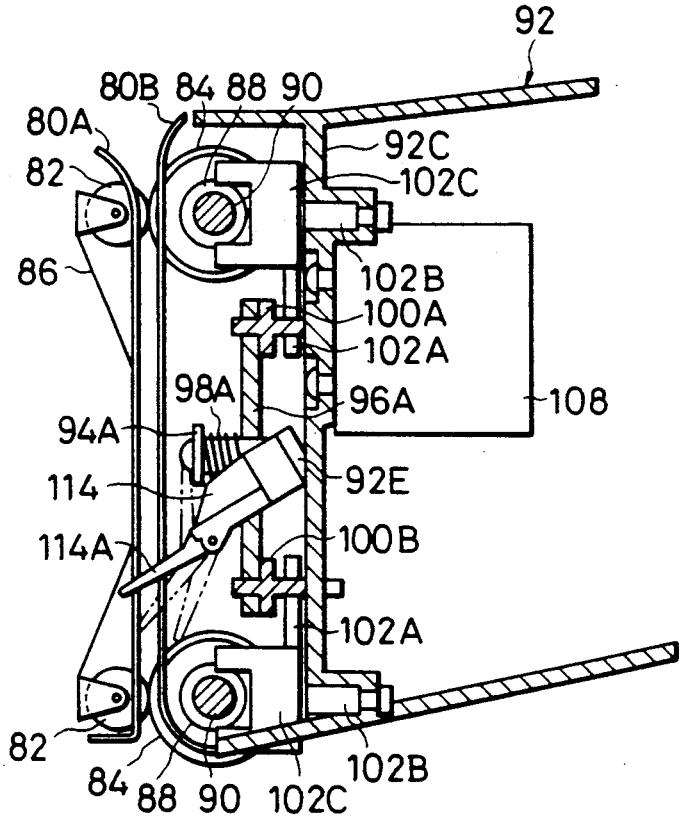
FIG. 15 is a sectional view taken along line XV—XV in FIG. 13.
Figure 16:
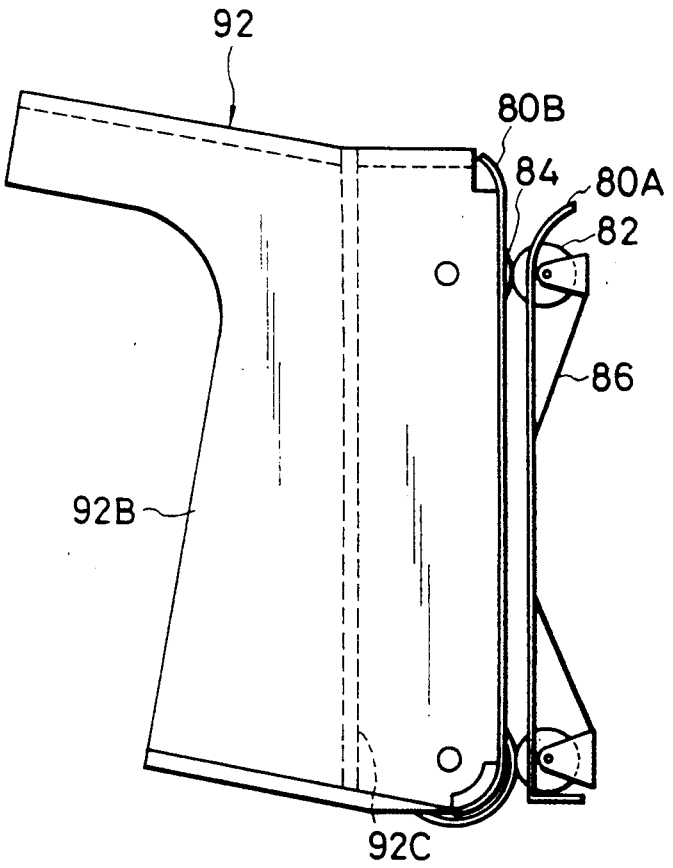
FIG. 16 is a view viewed in the direction of arrow XVI in FIG. 13.

In a struck out portion 92E formed in the center of the upper plate 92C of the case 92, there is provided a first passage sensor 114 which detects a central portion of each sheet $S_1$ or $S_2$. In this embodiment, the first passage sensor 114 is a limit switch of which lever 114A is depressed by a sheet $S_1$ or $S_2$ for actuation, the lever 114A being located between the upper guide plate 80A and the lower guide plate 80B as shown in FIG. 15. In FIG. 13, the first passage sensor 114 is omitted for illustration purpose. As shown in FIG. 11, a second passage sensor 116 is provided at the right edge of the lower guide plate 80B so as to detect passage of a right hand edge of each sheet $S_1$ or $S_2$. In this embodiment, the second passage sensor 116 is a photosensor.

Shift Mechanism of the Tray Section B

Geneva wheel assemblies 40 and 42 are provided on the outside portions of the side frames 10A and 10B, respectively. The Geneva wheel assemblies 40 and 42 are identical to each other but are mirror symmetrically arranged, and only the right side Geneva wheel assembly 40 will be described. The Geneva wheel assembly 40 includes a pair of Geneva wheels $40_1$ and $40_2$ as shown in FIG. 4. The Geneva wheel $40_1$ is equal in diameter to the Geneva wheel $40_2$ and is arranged above the Geneva wheel $40_2$. The Geneva wheels $40_1$ and $40_2$ are provided with grooves $40C_1$ and $40C_2$ to engage with a rear tray pin 12G, respectively. The Geneva wheels $40_1$ and $40_2$ are secured to shafts $40A_1$ and $40A_2$ rotatably supported on the right side frame 10A, respectively. Gears $40B_1$ and $40B_2$ which are equal in diameter to each other are also mounted on the shafts $40A_1$ and $40A_2$ and rotate together with the Geneva wheels $40_1$ and $40_2$, respectively. The Gears $40B_1$ and $40B_2$ engage a gear $40B_3$. As shown in FIG. 21, the shafts $40A_1$ and $40A_2$ are aligned in parallel with vertical portions $10C_4$ and $10C_5$ of the first slot 10C.

The Geneva wheels $40_1$ and $40_2$ are arranged so that the grooves $40C_1$ and $40C_2$ are rotated with a predetermined difference in phase from each other.

Figure 6:
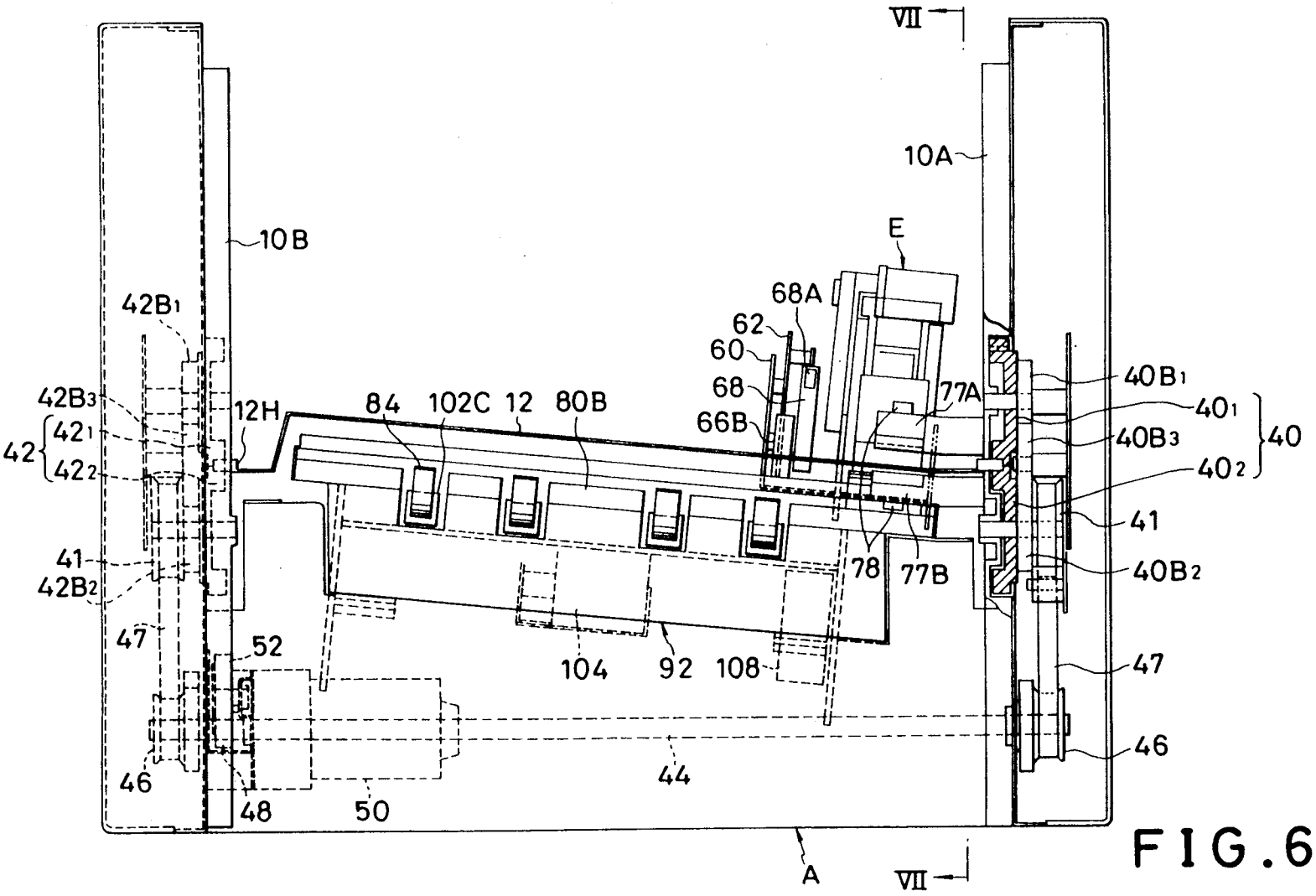
FIG. 6 is a view as viewed in the direction of arrow VI in FIG. 4.

A timing belt 47 extends between a driven pulley 41 and a transmission pulley 46. The driven pulley 41 is mounted on the lower shaft $40A_2$, and the transmission pulley 46 is secured to a shaft 44 which is rotatably supported on the side frames 10A and 10B. As shown in FIG. 6, a transmission pulley 48 is mounted on the shaft 44, and meshes with a drive gear 52 which is secured to the output shaft of an electric motor 50 mounted on the left side frame 10B. The shaft 44 has another transmission pulley 46 secured at the other end thereof, and this transmission pulley 46 is connected to another driven pulley 41 through another timing belt 47. This driven pulley 41 is mounted on a shaft on which the Geneva wheel $42_2$ is mounted.

The Geneva wheels $40_1$, $40_2$ and $42_1$, $42_2$ are, as described hereinafter, arranged so that grooves $40C_1$, $40C_2$ and $42C_1$, $42C_2$ are engageable with rear tray pins 12G and 12H, respectively. In this embodiment, the Geneva wheels $40_1$ and $42_1$ are equal in height of the mounted positions thereof, and Geneva wheels $40_2$ and $42_2$ equal in height of the mounted position thereof. The rear tray pin 12G of each tray $12_1$–$12_n$ is provided at the same height as the bottom wall 12A thereof whereas the rear tray pin 12H thereof at the height of the lower edge of the left side wall 12C. Consequently, each tray $12_1$–$12_n$ is held in such a fashion that the bottom wall 12A thereof is inclined rearwardly as well as rightwardly; the tray is thus held with the cutout 12E placed lowermost.

With such a construction, the right and left transmission pulleys 46 are rotated in the same direction by energizing the motor 50, so that two pairs of Geneva wheels $40_1$ and $42_1$; $40_2$ and $42_2$ are rotated. As shown in FIGS. 21 (A) to 21 (E), this causes the rear tray pins 12G and 12H of one tray to engage with grooves 40C and 42C of Geneva wheel assemblies 40 and 42, respectively. The rear tray pins 12G and 12H of the tray are thus elevated along the arcuate portions $10C_1$, $10C_2$ of the first slot 10C and arcuate portions $10D_1$, $10D_2$ of the first slot 10D, respectively. This rearwardly enlarges the gap between the tray and an adjacent lower tray thereof. As the rear tray pins 12G and 12H move along respective first slots 10C and 10D, the dummy pins 16D and 18D and the resist pins 16F and 18F of the tray carrier 15 move. By the displacement of the resist pins 16F and 18F the tray carrier 15 is moved along the second slots 10E and 10F.

A cam 54 is mounted on the upper right shaft $40A_1$ at a position determined in connection with the groove $40C_1$, and a position detection switch 56 is provided to the right side frame 10A at a position corresponding to the position of cam 54 for detecting the stop position of the upper Geneva wheel $40_1$. The position detection switch 56 is switched when the cam 54 is brought into contact with an activating lever 56A thereof.

A lower limit detection switch 58 is mounted to the right side frame 10A adjacent to the lower end of the first slot 10C. The lower limit detection switch 58 is switched by bringing a lowermost rear tray pin 12G into contact with the actuating lever 58A when the dummy pins 16D and 18D are respectively placed within the grooves $40C_1$ and $42C_1$ of the upper Geneva wheels $40_1$ and $42_1$, and when the position detection switch 56 detects the stop position of the cam 54.

Drawing-out Mechanism of the Trays

Description will be given about a tray drawing out mechanism which draws out trays $12_1$–$12_n$ for performing stapling operation of sheets stacked on the trays.

The tray drawing out mechanism is constituted by combining the first slots 10C and 10D and the pair of the Geneva wheel assemblies 40 and 42 which are mirror symmetrically arranged to the side frames 10A and 10B. Only the right side portion of the tray drawing out mechanism will be hence described.

Figure 21A:
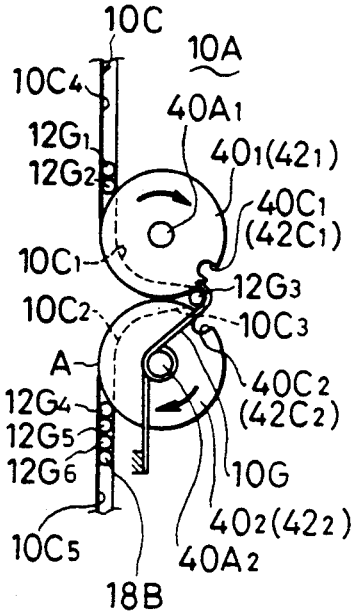
FIGS. 21A-E are enlarged side views of an essential portion of the tray holding mechanism of FIG. 4, illustrating the operation thereof.
Figure 21B:
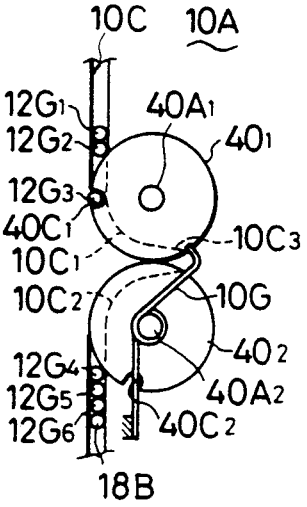
Figure 21C:
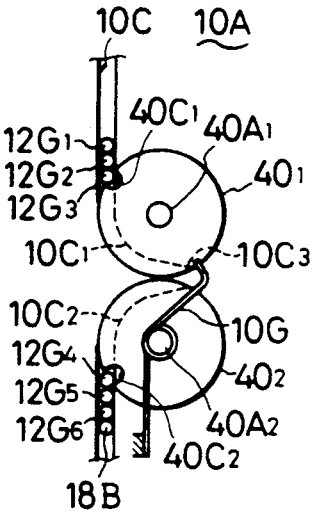
Figure 21D:
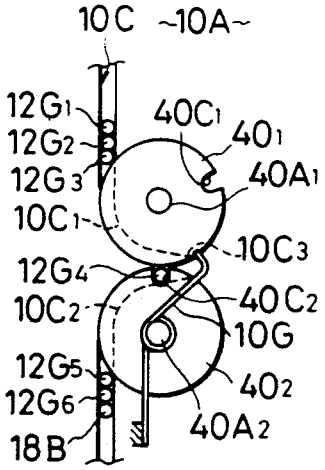
Figure 21E:
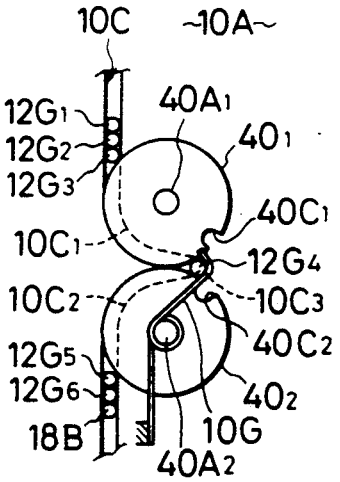

As shown in FIGS. 21(A) to 21(E), the first slot 10C is continuously formed in the right side frame 10A so that it has opposite vertical portions $10C_4$ and $10C_5$ and symmetrical arcuate portions $10C_1$ and $10C_2$ communicated to the vertical portions $10C_4$ and $10C_5$, respectively. The arcuate portions $10C_1$ and $10C_2$ are formed to overlap quarters of the circular loci of the groove $40C_1$ of the Geneva wheel $40_1$ and the groove $40C_2$ of the Geneva wheel $42_1$, respectively. The arcuate portions $10C_1$ and $10C_2$ communicate to each other at an extended portion $10C_3$ which extends in a direction of a common tangent of the Geneva wheels $40_1$ and $40_2$. While being shifted, each tray is, as shown in FIG. 21(E), pulled out rearwardly by about ¾ of the diameter of the Geneva wheels $40_1$ and $40_2$ by the guiding of the first slot 10C.

A return spring 10G is provided to the right side frame 10A so that an upper end portion thereof is located at the inner end portion of the extended portion $10C_3$. The upper end portion of the return spring 10G biases a rear tray pin 12G, which comes out of the groove $40C_1$ or $40C_2$, against the outer circumferential surfaces of the Geneva wheels $40_1$ and $40_2$, and then temporarily holds it.

Stapler E

The stapler E is secured to the causing body A at a position to oppose to the cutout 12E of a tray which has been pulled out rearwardly by the tray drawing out mechanism described above. The stapler E performs a stapling operation on sheets S located on the tray.

As the stapler E, electric staplers 5000 series sold by Swingline, U.S.A., for example, may be used.

Sheet Holding Mechanism

Figure 17:
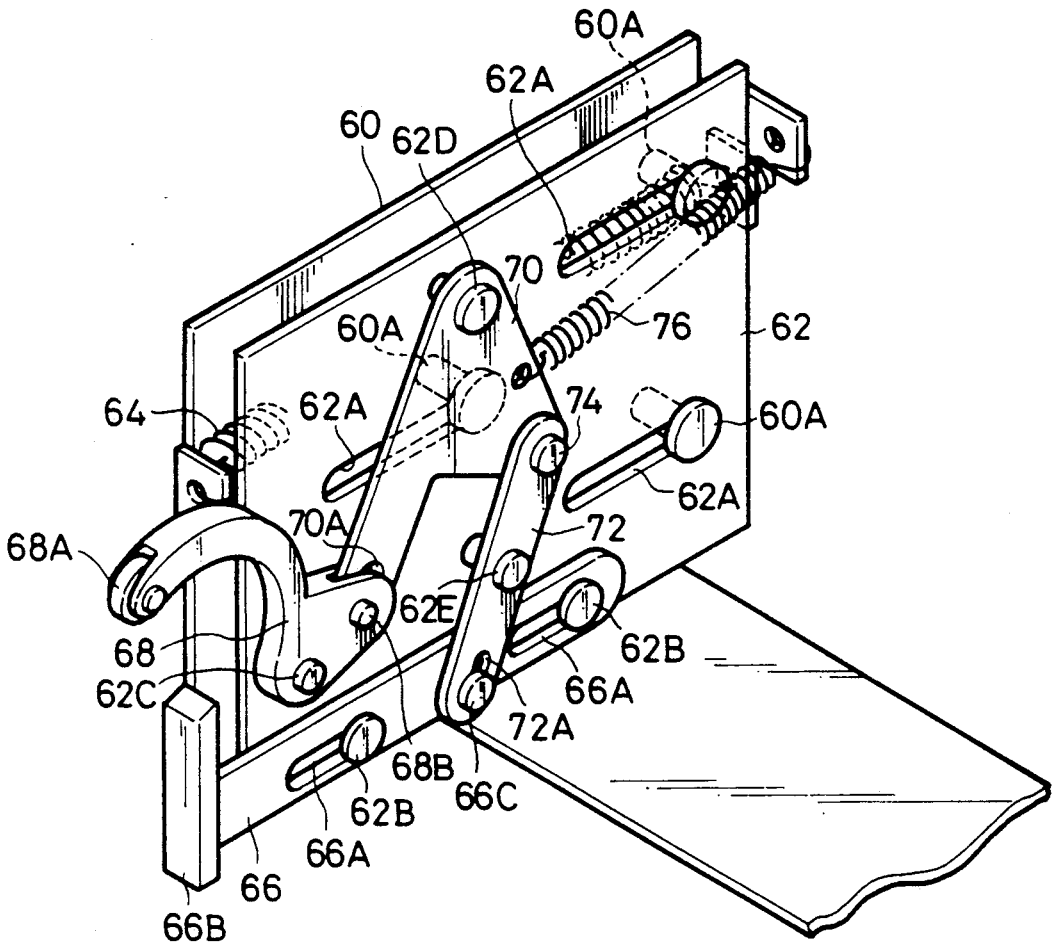
FIG. 17 is an enlarged perspective view of the sheet putting aside mechanism of FIG. 4.

In the vicinity of the stapler E, there is provided a sheet pressing mechanism, shown in FIG. 17, for pressing sheets to be stapled. The sheet pressing mechanism includes base plate 60 which is fastened to the main frame 10. The base plate 60 has a pluarality of (three in this embodiment) guide pins 60A fixed to it. A slide plate 62 is arranged to be slidable forward and backward by fitting the guide pins 60A into respective slots 62A formed through it. A spring 64 is extended between the forward end of the base plate 60 and the rear end of the slide plate 62 to spring bias the slide plate 62 forward. The slide plate 62 has a pair of guide pins 62B fixed to it, and a slider 66 is provided to be slidable forward and backward by inserting the guide pins 62B into respective slots 66A formed through the slider 66. A touch plate 66B is mounted to a foward end of the slider 66, and is designed to be pushed backward by coming into abutment against the rear side wall 12D of a tray $12_1$–$12_n$ which is being pulled backward by the tray drawing out mechanism.

A sheet pressing lever 68 is rotatably supported at in intermediate portion thereof on a supporting pin 62C which is fixed to a forward portion of the slide plate 62. A forward portion of the sheet pressing lever 68 is curved forwardly, and has a pressing roller 68A rotatably supported on the forward end thereof. The rear end of the sheet pressing lever 68 is related to the slider 66 through a first link 70 and a second link 72. More specifically, the links 70 and 72 are rotatably supported on a supporting pins 62D and 62E mounted on the slide plate 62, respectively. The links 70 and 72 are connected at one ends thereof through a connection pin 74. A connection pin 68B, mounted on the rear end of the sheet pressing lever 68 is fitted into a slot 70A formed through the other end of the first link 70 whilst a connection pin 66C fixed to an intermediate portion of the slider 66 passes through a slot 72A formed through the other end of the second link 72.

A spring 76 is provided between the one end of the first link 70 and the rear end of the slide plate 62. The slider 66 is hence biased forwardly while the sheet holding lever 68 is urged in a direction to raise the holding roller 68A.

Figure 18:
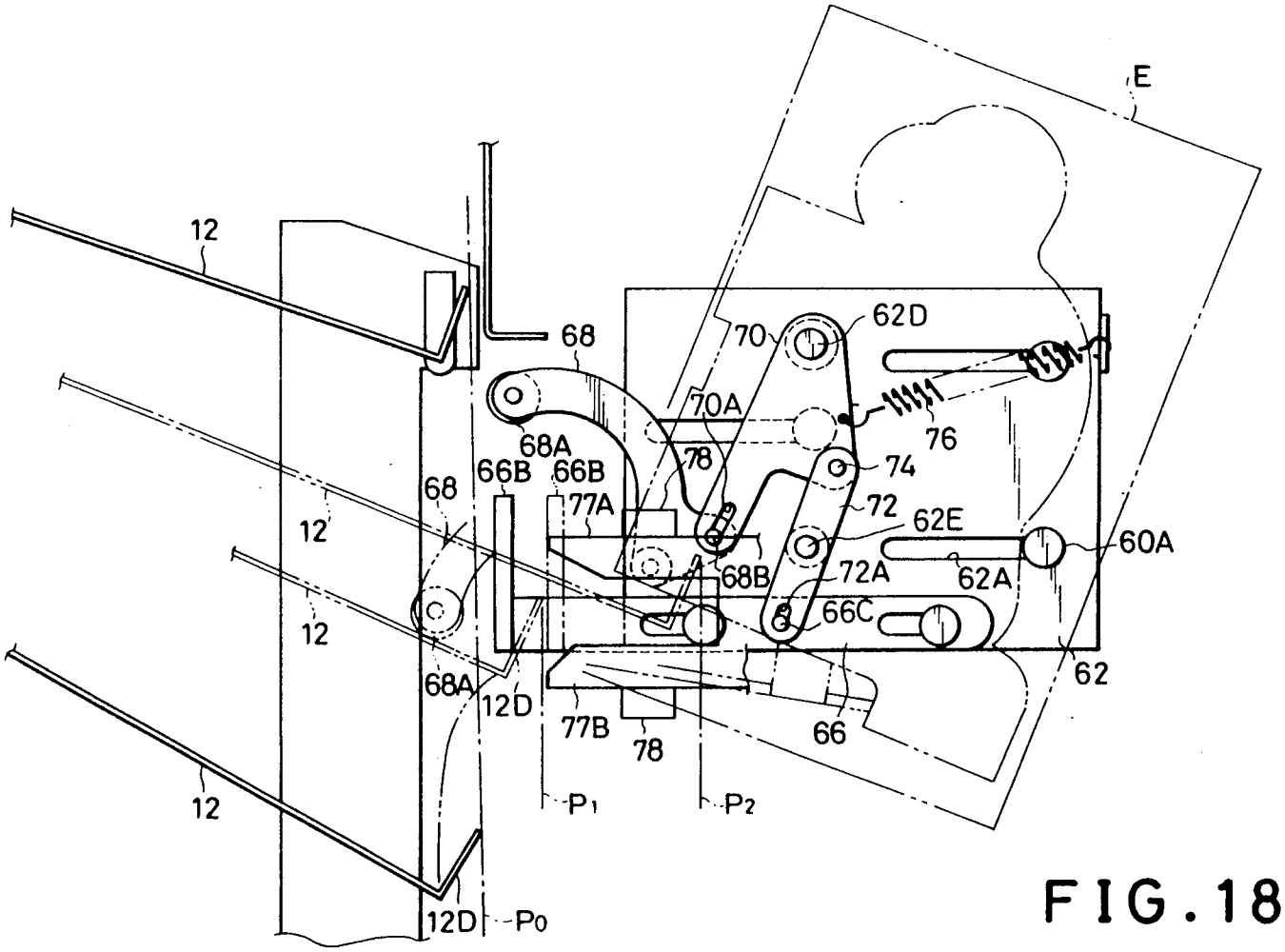
FIGS. 18 to 20 are enlarged side views illustrating the operation of the sheet putting aside mechanism of FIG. 4.
Figure 19:
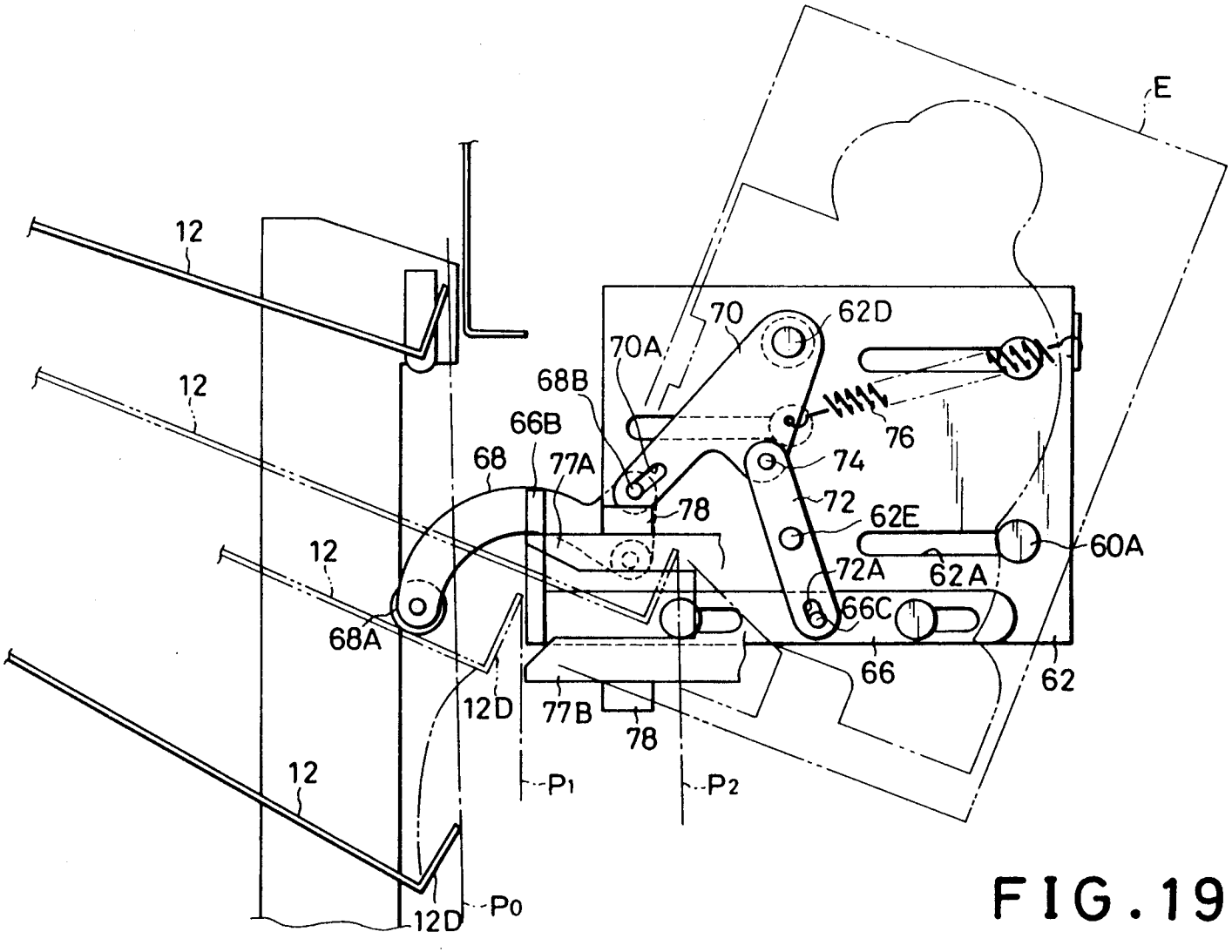
Figure 20:
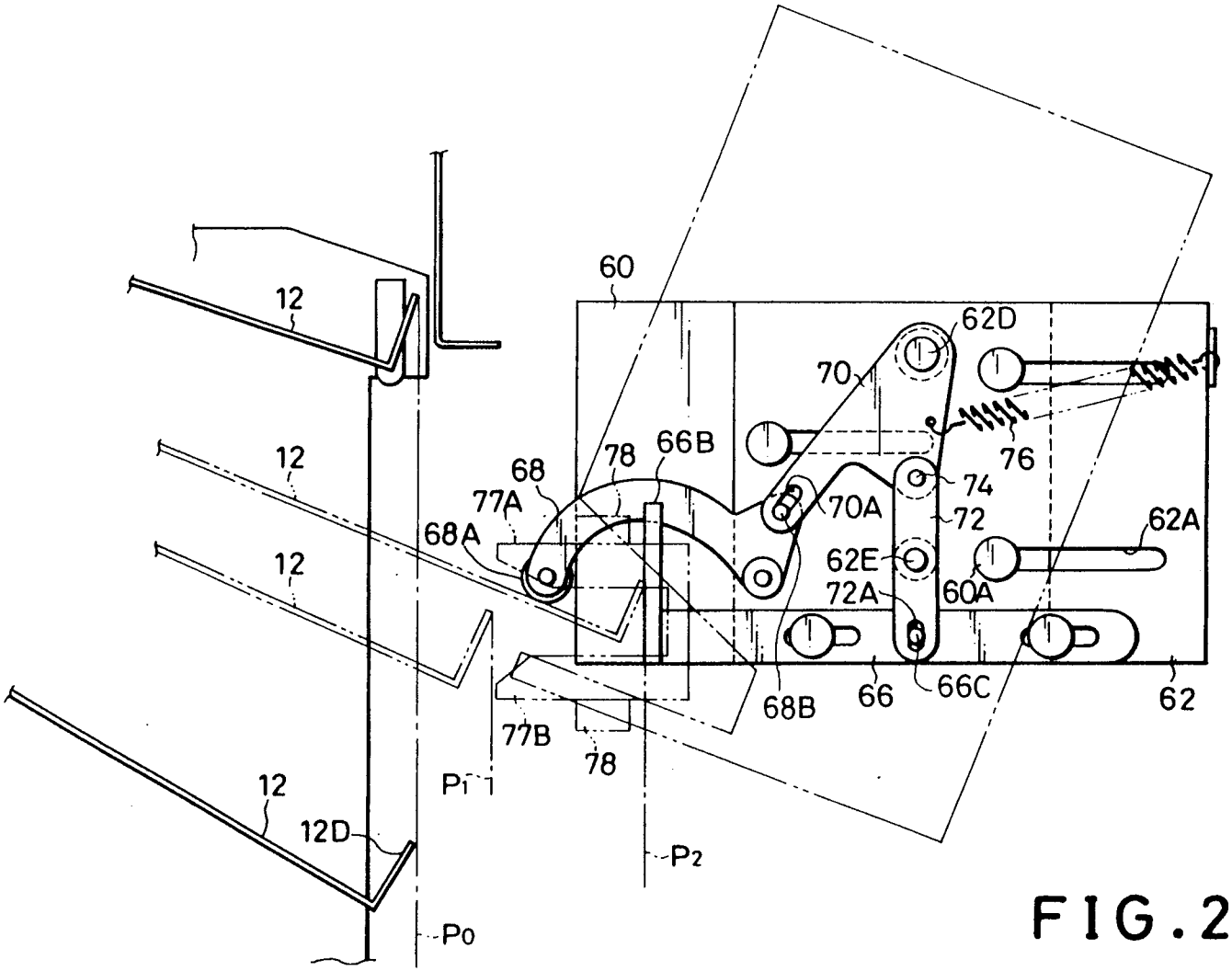

Each tray is pulled rearward by the tray drawing out mechanism, and the rear side wall 12D of the tray thereby moves from an aligned position $P_0$ in FIG. 18 to a maximum drawn out postion $P_2$ through an intermediate drawn out position $P_1$. During this operation, the slider 66 is firstly pushed and moved backward relative to the slide plate 62, and the sheet pressing lever 68 is then swung in the counter-clockwise direction in FIG. 19 to depress the sheets on the tray. Thereafter, as shown in FIG. 20, the slider plate 62 and the slider 66 in unison move backwardly relative to the base plate 60 together with the tray 12 with the sheets on it pressed by the sheet presssing lever 68. In this operation, the spring 64 which biases the slide plate 62 is expanded after the spring 76 which urges the slider 66 is expanded. For this reason, the biasing force of the spring 76 is designed to be smaller than that of the spring 64.

When the tray 12 is drawn out to the maximum position, the portion of the stack of sheets placed above the cutout 12E of the rear right corner thereof is guided between upper and lower sheets guides 77A and 77B and then stapled. The sheet guides 77A and 77B are secured at predetermined positions of the main frame 10 in casing body A. As shown in FIG. 5, photosensor 78 is provided to the sheet guides 77A and 77B for detecting whether or not sheets are present at the stapling position.

Operation of the Embodiment

The operation of the sorter will be described. Electric signals of information, such as the number of pages and the number of copies of a document to be copied are sent from a host machine, not shown, to a sorter control unit provided to the casing body A. The host machine is a photocopier, for example and the sorter control unit is constituted by a microcomputer not shown. According to the signals, the motor 50 is energized, and the Geneva wheel assemblies 40 and 42 are thereby rotated in the same direction. This causes the rear tray pins 12G and 12H of each trays $12_1$–$12_n$ to engage with respective grooves 40C and 42C, and the trays are sequentially shifted downwardly. As a result, the uppermost tray $12_1$ is, as shown in FIG. 7, positioned just below the outlet of the guide plates 80A and 80B of the sheet putting aside mechanism, and thus the sorter is placed in a tray initial state.

Figure 7:
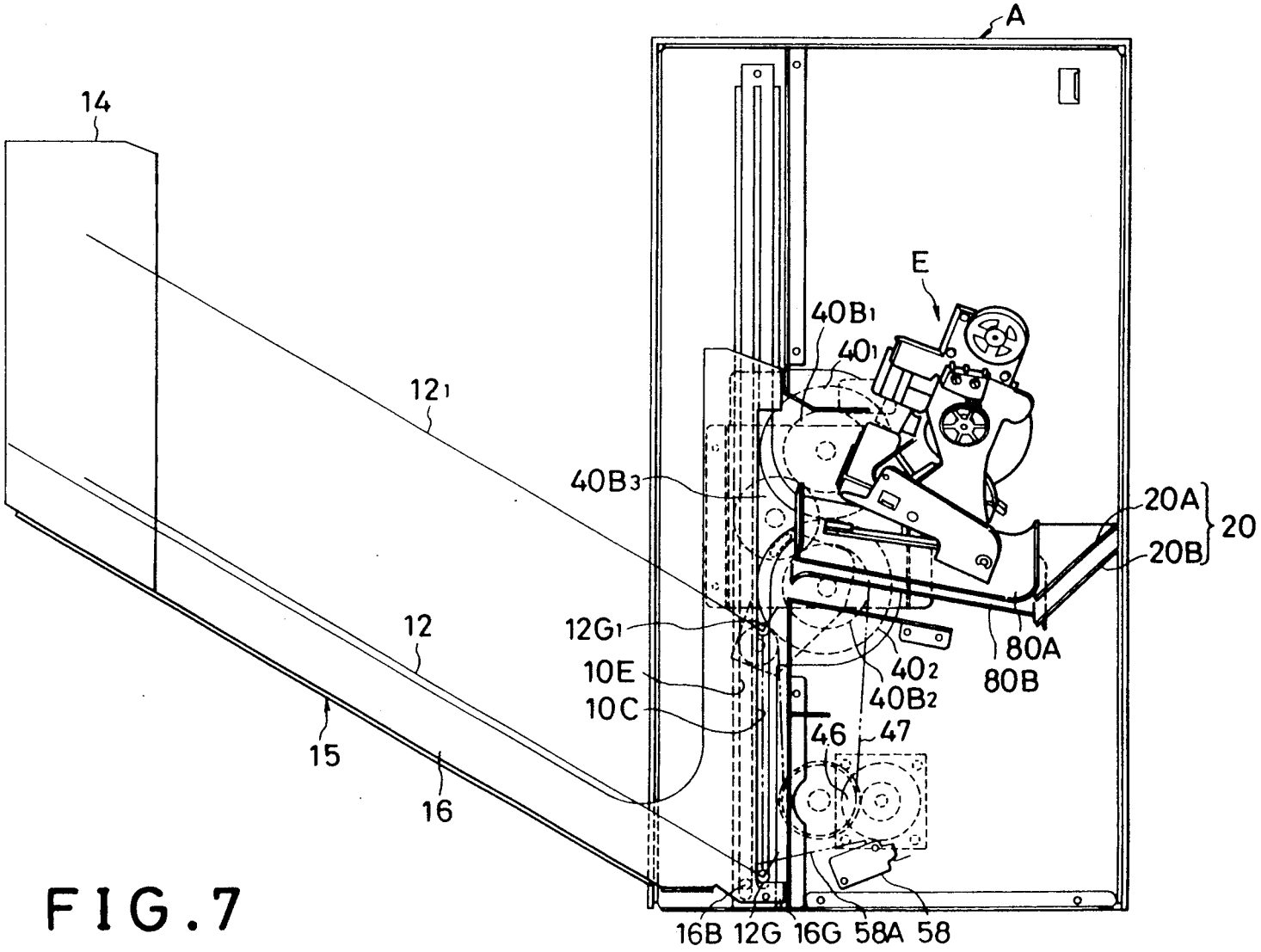
FIG. 7 is a sectional view taken along line VII—VII in FIG. 6.

In the tray initial state, the rear pins $12G_1$ and $12H_1$ of the uppermost tray $12_1$, as shown in FIG. 7, come into contact with the cicumferential surfaces of the lower Geneva wheels $40_2$ and $42_2$ in the first slots 10C and 10D, respectively. On the other hand, the dummy pins 16D and 18D of the tray carrier 15 are, as shown by the dots-and-dash line in FIG. 9, engaged with the grooves $40C_1$ and $42C_1$ of the upper Geneva wheels $40_1$ and $42_1$, are thereby guided rearwardly, and are then disengaged. In this event, the dummy pins 16D and 18D are urged against the outer circumferential surfaces of the Geneva wheels $42_1$ and $42_2$; $40_1$ and $40_2$ by the spring 10G, respectively. In this state, the links 16C and 16E; 18C and 18E which support the dummy pins 16D and 18D are placed in open conditions opening at a maximum angle as shown by the dots-and-dash line in FIG. 9. This tray initial state is detected by activating the lower limit detection switch 58 with the lowermost rear pin 12G, and a shifted tray counter, not shown, is thereby reset.

A copied sheet is introduced into the transporting guide 20, through which it is discharged on the uppermost tray $12_1$ by the pinch rollers 82 and feed rollers 84 of the sheet putting aside mechanism driven by the motor 32.

Figure 23:
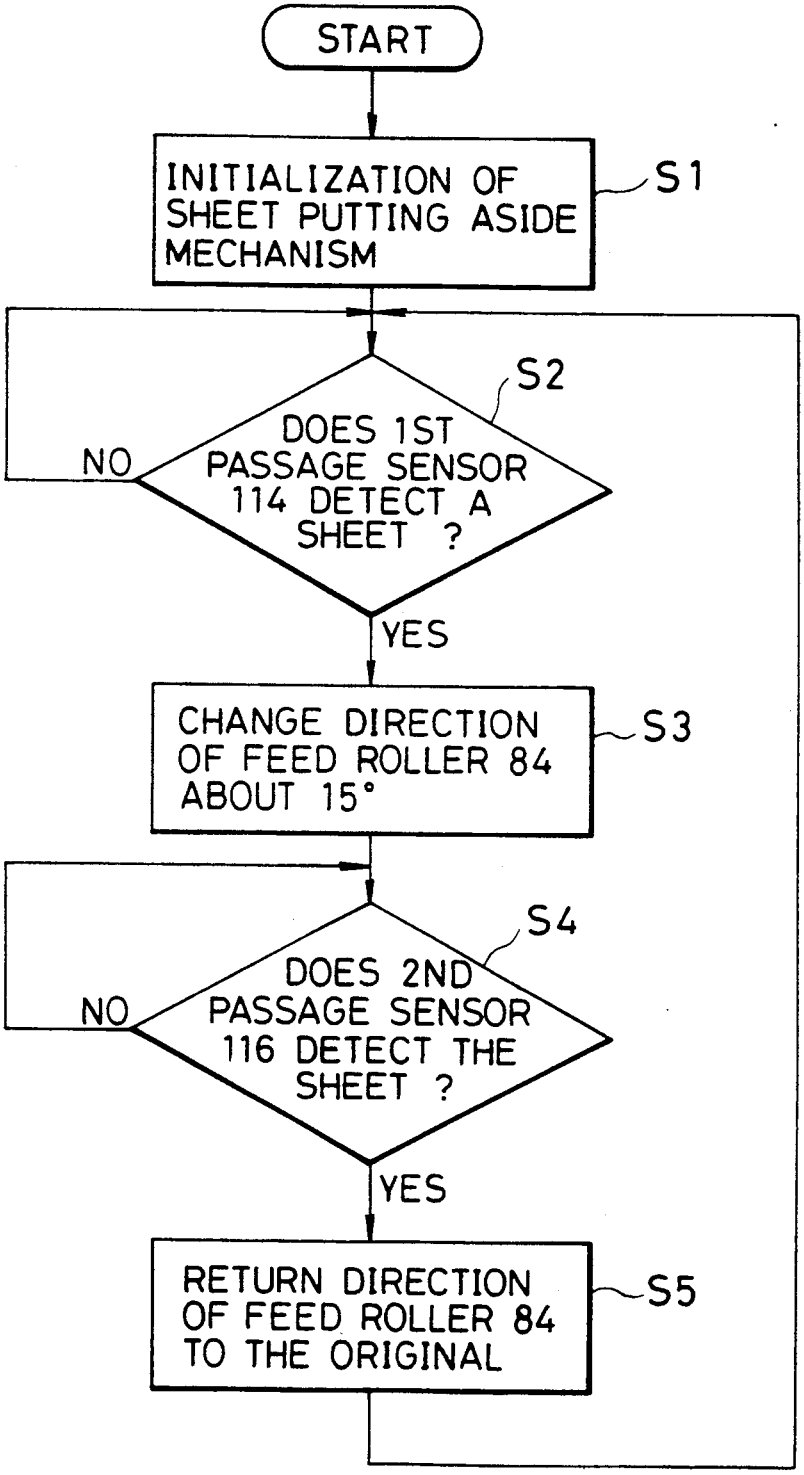
FIG. 23 is a flow chart illustrating the operation routine of the sheet putting aside mechanism in FIG. 4.

In this event, the sheet putting aside mechanism changes the direction of the feed rollers 84 according to the control sequence shown by a flow chart of FIG. 23.

In step S1 of the control sequence, the sheet putting aside mechanism is initialized, thereby directing the feed rollers 84 forward (leftward in FIG. 12) and starting driving them. After the detection of a sheet by the first passage sensor 114 is confirmed in step S2, the direction of the feed rollers 84 is changed to turn 15° counterclockwise in FIG. 12 (as shown by broken lines) in step S3. Then, in step S4 it is judged whether or not the second passage sensor 116 detects the edge of the sheet. When an affirmative result is given, in step S5 the feed rollers 84 is returned to the original direction. Thereafter, the routine is returned to step S2.

With this operation of the sheet putting aside mechanism, a sheet is moved forwardly and rightwardly (downwardly in FIG. 12), and are discharged on a tray 12 in this fashion. The sheet dropped on the tray slides down the inclined surface of the bottom wall by gravity and is aligned by the right side wall 12B and the rear side wall 12D of the tray.

Every time when the first passage sensor 114 detects passage of a sheet, the control unit sends a signal to engergize the motor 50, and the Geneva wheel assemblies 40 and 42 are thereby rotated to shift trays 12 upwardly.

The shift operation and the rearward drawing out operation of the trays 12 will be described in detail with reference to FIGS. 21 (A) to (E) and 22.

FIG. 21(A) illustrates a state in which a sheet is dischargeable to the fourth tray $12_4$ from the top. In this state, the rear tray pin $12G_4$ of the tray $12_4$ is in contact with the circumferential surface of the lower Geneva wheel $40_2$. The third rear tray pin $12G_3$ is positioned at the extended portion $10C_3$, and is out of engagement with the groove $40C_1$ of the Geneva wheel $40_1$ and the groove $40C_2$ of the Geneva wheel $40_2$. The rear tray pin $12G_3$ is held against the circumferential surfaces of the Geneva wheels $40_1$ and $40_2$ by the return spring 10G. Thus, the tray section B is opened between the third tray $12_3$ and the fourth tray $12_4$. In this state, the groove $40C_1$ of the Geneva wheel $40_1$ and the groove $40C_2$ of the Geneva wheel $40_2$ are, as shown in FIG. 21(A), positioned with a predetermined difference in phase.

From this state of FIG. 21(A), the Geneva wheels $40_1$ and $40_2$ ($42_1$ and $42_2$) are turned in respective directions shown by arrows. The rear tray pin $12G_3$ is then pushed into the groove $40C_1$ during rotation of the Geneva wheel $40_1$, and when the Geneva wheels $40_1$ and $40_2$ reach positions shown in FIG. 21(B), the Geneva wheel $40_1$ transports the rear tray pin $12G_3$ to the inlet of the vertical portion $10C_4$ of the first slot 10C. On the other hand, the groove $40C_2$ of the lower Geneva wheel $40_2$ is located at a lower position.

The Geneva wheels $40_1$ and $40_2$ are further rotated from the state of FIG. 21(B), and in a state shown in FIG. 21(C) the third rear tray pin $12G_3$ is disengaged from the groove $40C_1$ of the Geneva wheel $40_1$. At the same time, the fourth rear tray pin $12G_4$ fits in the groove $40C_2$ of the lower Geneva wheel $40_2$.

In a state shown in FIG. 21(D) in which the Geneva wheels $40_1$ and $40_2$ are turned further from the state of FIG. 21(C), the fourth rear tray pin $12G_4$ is guided in the arcuate groove $10C_2$ while it is engaged with the groove $40C_2$ of the lower Geneva wheel $40_2$.

The Geneva wheels $40_1$ and $40_2$ are further turned from the state of FIG. 21(D) to the state of FIG. 21(E), during which the fourth rear tray pin $12G_4$ is guided by the extended portion $10C_3$ the first slot 10C, and is then disengaged from the groove $40C_2$ of the lower Geneva wheel $40_2$. In FIG. 21(E), the fourth rear tray pin $12G_4$ is held between the circumferential surfaces of the Geneva wheels $40_1$ and $40_2$ and the return spring 10G.

During the operations of the Geneva wheels $40_1$ and $40_2$ from the state of FIG. 21(A) to the state of FIG. 21(E), each of the Geneva wheels $40_1$ and $40_2$ makes one revolution, so that the shift operation of the tray is completed as well as the drawing out operation of the next tray.

By this shift of each tray, the dummy pins 16D and 18D and the resist pins 16F and 18F are shifted together with the rear tray pins 12G and 12H, so that the tray carrier 15 is synchronously shifted.

In this embodiment, the guiding of the rear tray pins 12G and 12H in the tray drawing out operation is carried out by the extended portion $10C_3$ which extends in the common tangent direction of the Geneva wheels $40_1$ and $40_2$, and the rearward displacement of the rear portion of each tray is achieved without considerable vertical movement.

The shifting operation of trays is carried out according to the number of the copies of the document.

Figure 22:
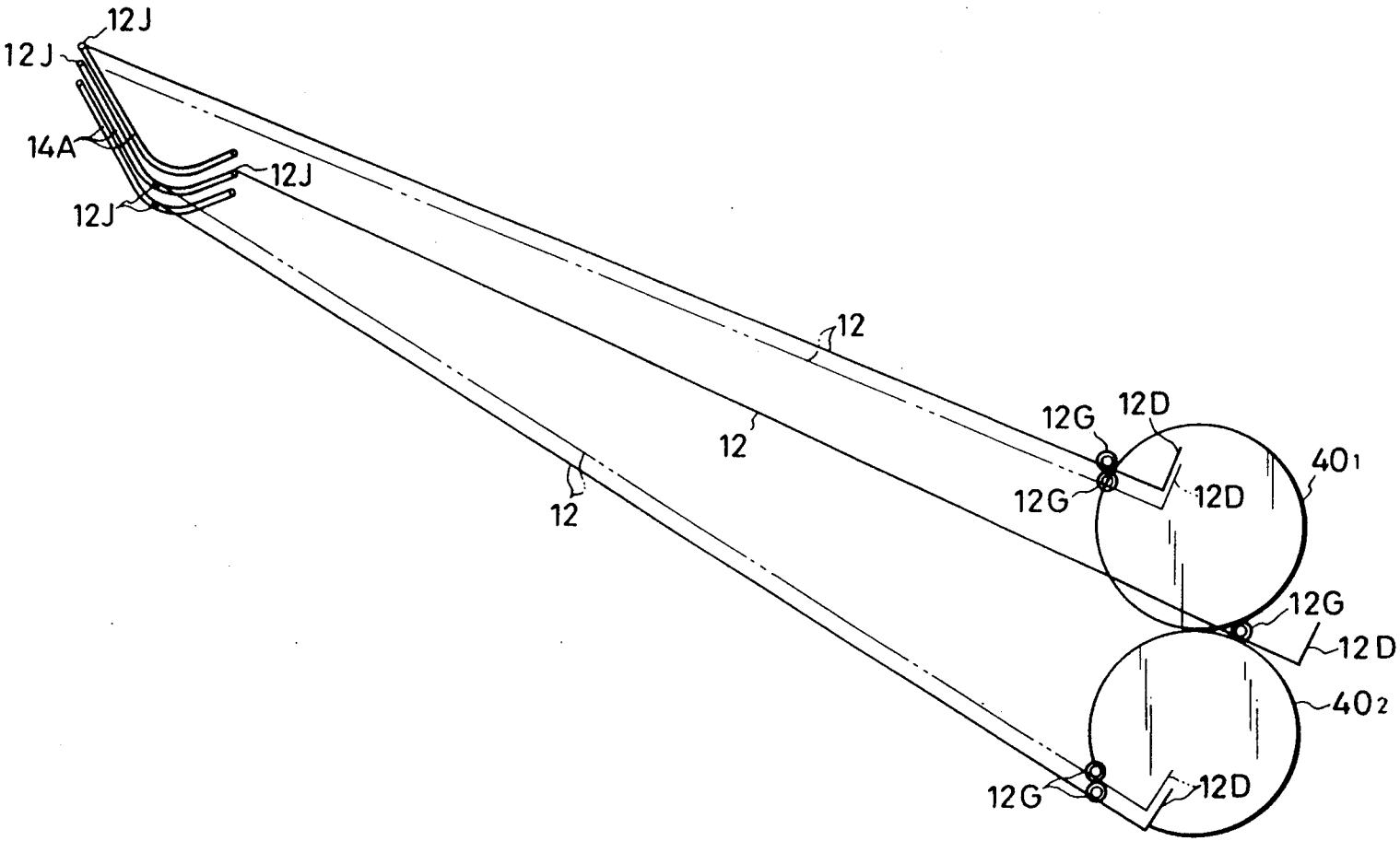
FIG. 22 is an enlarged side view of an essential portion of the tray holding mechanism of FIG. 4, illustrating how trays are moved by the tray holding mechanism.

In the shifting operation of trays 12, the rear tray pins 12G and 12H of each of trays are moved upwardly rearwardly while guided in the respective first slots 10C and 10D. On the other hand, the front tray pins 12I and 12J of each of trays are raised obliquely upwardly while they are guided by respective inclined guide grooves 14A, 14A of the front guide members 14, 14. The guide grooves 14A are formed in a V-shape as shown in FIG. 22, each having a downwardly inclined front portion and an upwardly inclined rear portion. This enables the space between a tray, on which a sheet discharged is received, and an upper tray positioned just above the tray to be enlarged to thereby increase the receiving space of sheets in the tray. The discharging operation of the sheet is thus facilitated.

When copying of a predetermined number of sheets is completed for a page of the document, the trays $12_1$–$12_n$ are returned to the tray initial state by reversing the motor 50. Then, the sorting operation is performed for the next page.

When copying of all the pages is finished, the stapling operation will be conducted. The stapling operation is carried out on sheets stacked on the tray which has been pulled rearwardly. The pulling out operation of trays is performed simultaneously with the sequential shifting operation of trays $12_1$–$12_n$ from the tray initial state.

In the tray initial state, the shifts number counter is reset by activating the lower limit detection switch 58. The position detection switch 56 is actuated by the cam 54 every revolution of the Geneva wheels $40_1$ and $42_1$, so that it is detected what tray from the top is placed at the drawn out position.

When it is judged that a predetermined tray $12_1$–$12_n$ is placed at the drawn out position, the stapling operation is performed by the stapler E after confirmation of sheets on the tray with the sensor 78. For this purpose, the sorter control unit has a construction shown by the functional blocks of FIG. 25.

Figure 24:
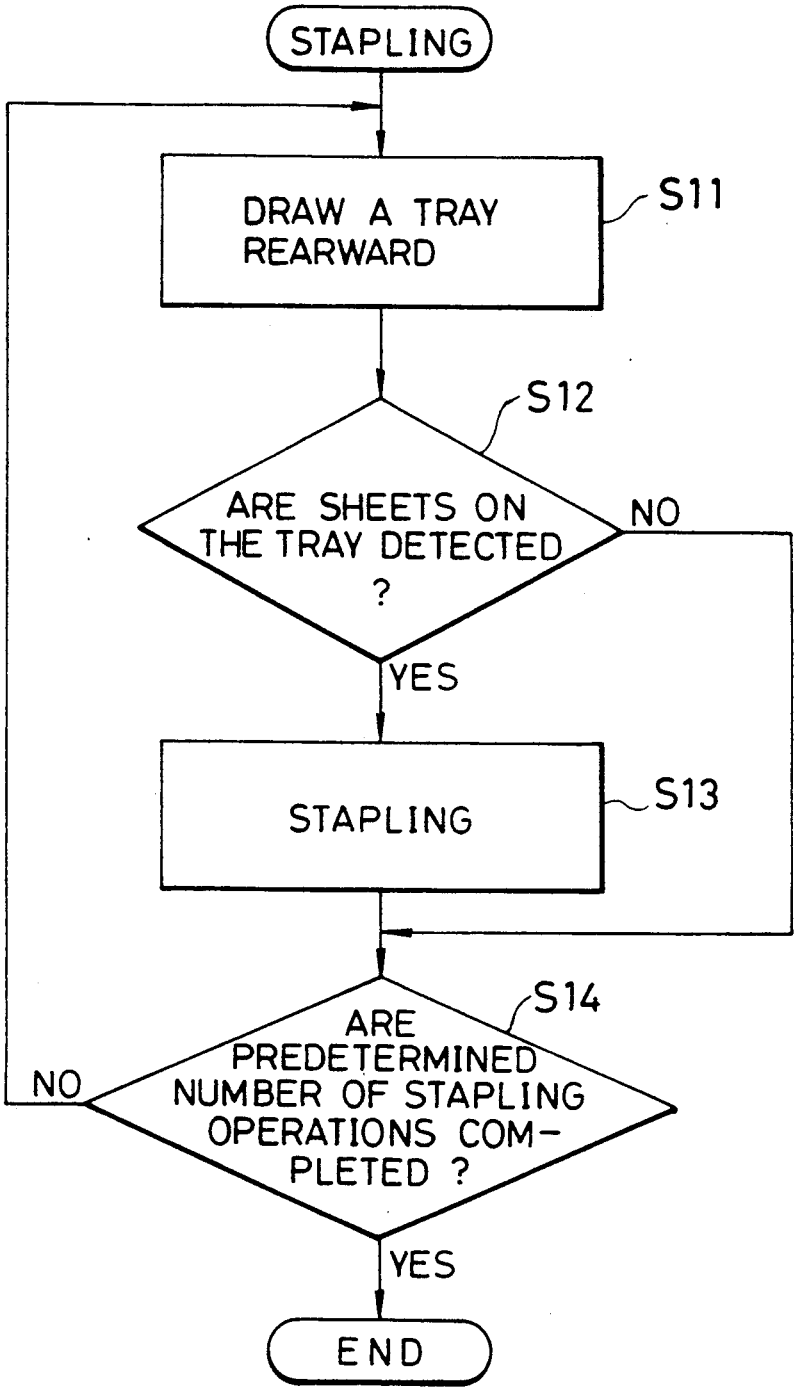
FIG. 24 is a flow chart illustrating the operation routine of the stapler in FIG. 4.
Figure 25:
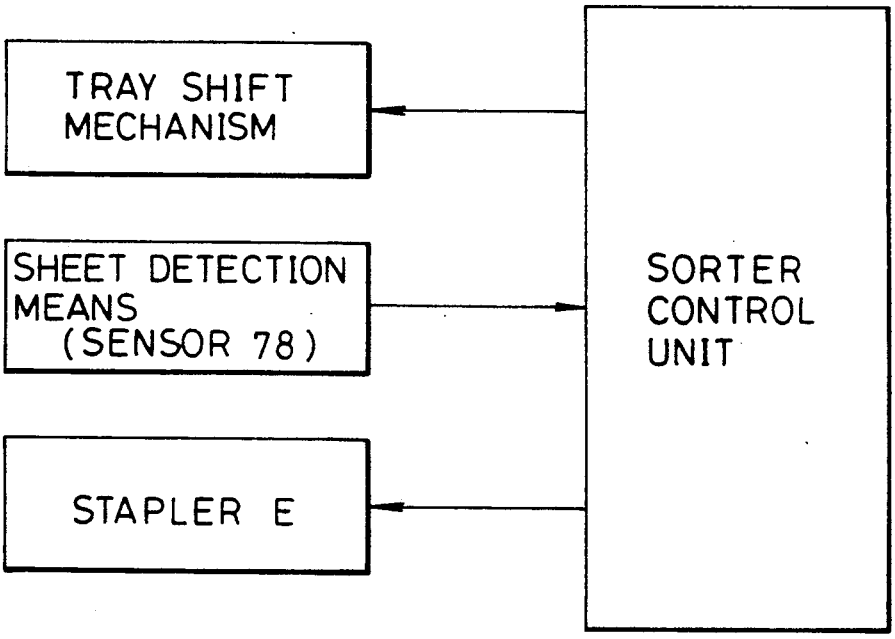
FIG. 25 is a block diagram showing the stapler control system of FIG. 4.

FIG. 24 illustrates a flow chart for carrying out the stapling operation by shifting the trays $12_1$–$12_n$ stepwisely. In the flow chart, a tray is drawn rearwardly (step S11), and then the sensor 78 detects whether or not sheets are places on the tray (step S12). Subsequently, the stapling operaton is performed if sheets are placed on the tray (step S13). These operations (steps S11–S13) are repeated by a predetermined number, and when it is judged that a predetermine number of the stapling opertions are conduced (step S14), the routine is ended.

During displacement of trays $12_1$–$12_n$ to the predetermined stapling position for the stapler E, the sheet pressing mechanism is actuated, so that sheets on trays are depressed not to separate. The sheets are thus certainly stapled in an aligned stacked condition.

In the embodiment, a tray is stationarily held in the drawn out position, and the stapling operation is surely carried out. Moreover, it is not necessary to stop the Geneva wheel assemblies 40 and 42 every stapling operation, so that load on the motor 50 is reduced. It is, however, possible to stop the motor 50 and the Geneva wheels $40_1$ and $40_2$: $42_1$ and $42_2$ every stapling operation, and even if there is somewhat a scattering in the stop position of the Geneva wheels $40_1$ and $40_2$: $42_1$ and $42_2$, the tray is held in the stationary position so that the positioning accuracy of the tray is secured.

The control of the direction of the feed rollers 84 of the sheet putting aside mechanism may be performed by a control unit of a host machine other than a sorter control unit, the host machine including, for example, a photocopier which discharges sheets.

Modified Form

Figure 26:
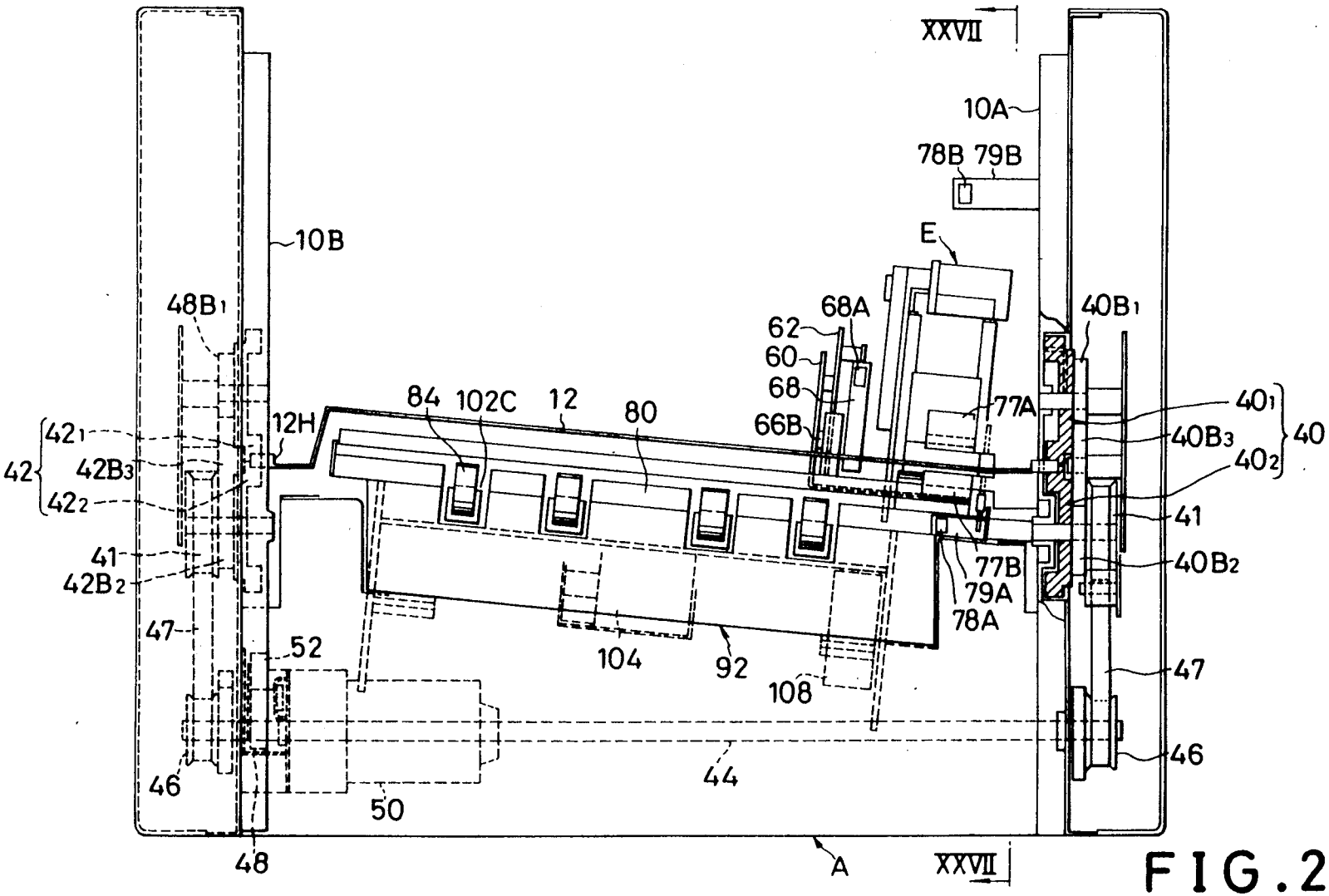
FIG. 26 is a front view, partly in section, illustrating a modified form of the sorter of FIG. 1.
Figure 27:
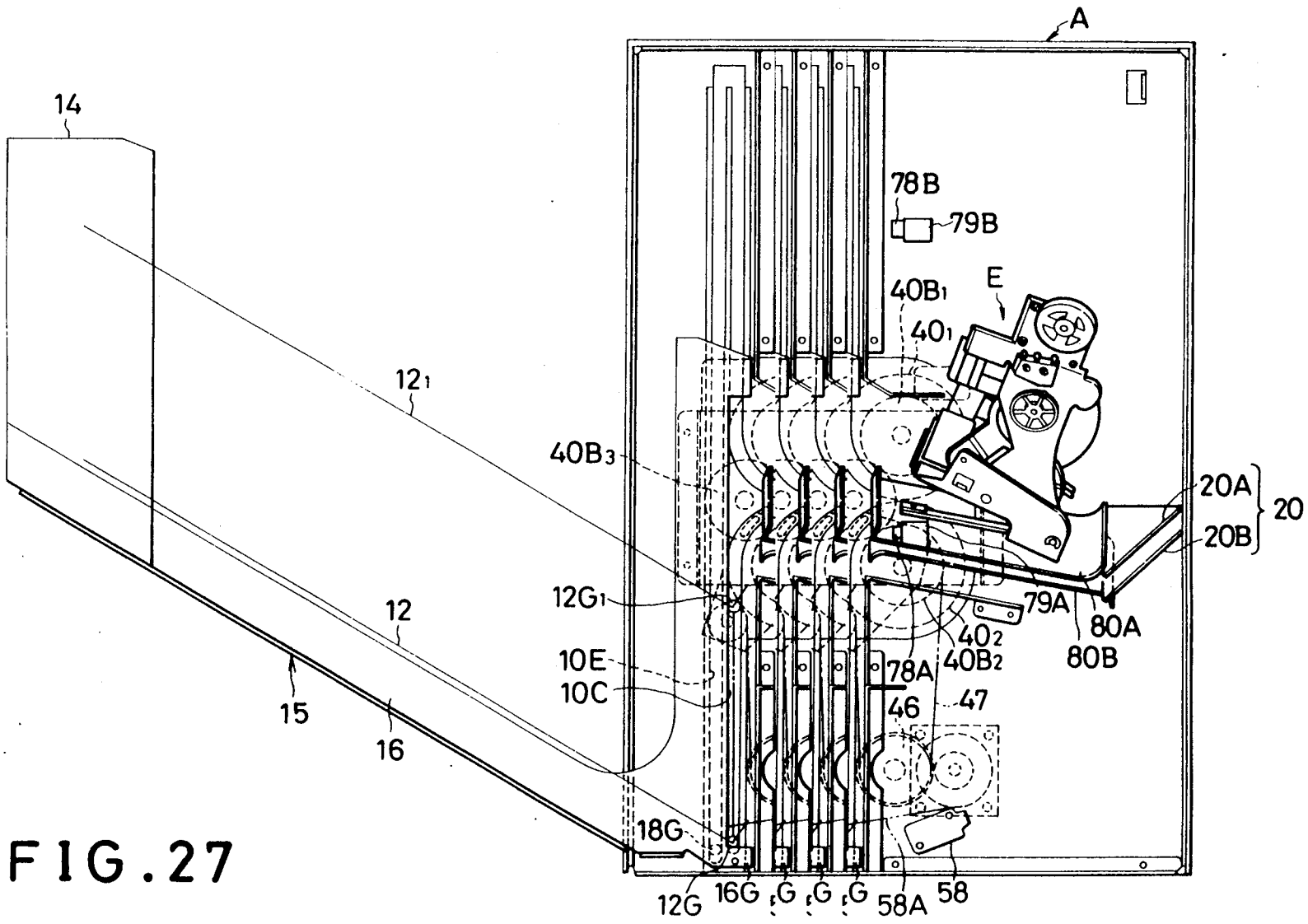
FIG. 27 is a sectional view taken along line XXVII—XXVII of FIG. 26.

A modified embodiment of this invention is shown in FIGS. 26 and 27, in which the sensor 78 is changed in position. A pair of members 78A and 78B which include light emitting and receiving elements respectively are disposed on an upper arm 79A and lower arm 79B, respectively. The upper and lower arms 79B and 79A are away from the sheet guides 77A and 77B. In this modified form, the arms 79A and 79B are integrally formed with the right side frame 10A by molding.

The present invention has been described in detaile with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. A sorter which comprising:

a plurality of receptacles arranged vertically movable and being capable of receiving articles to be treated;

means for sequentially shifting and drawing out each of said receptacles to a predetermined treatment position, the receptacles each having a front portion remote from the treatment position;

means for applying predetermined treatments to the articles on respective receptacles drawn out to the treatment position;

means for discharging one of the articles to a lower adjacent receptacle positioned just below the receptacle drawn out; and means for guiding the front portion of each receptacle diagonally upwardly to enlarge a space between said lower adjacent receptacle and said receptacle drawn out when the receptacle is drawn out.

2. A sorter as recited in claim 1, wherein said guide means comprises: a pin mounted to the front portion of each receptacle; and a guide groove substantially V-shaped for slidably guiding the pin.

3. A sorter as recited in claim 1, further comprises a receptacle carrier, arranged vertically movably, for carrying said plurality of receptacles.

4. A sorter as recited in claim 3, wherein said guide means comprises: a pin provided to the front portion of each receptacle; and guide groove, which is substantially V-shaped and provided to said receptacle carrier, for slidably guiding the pin.

5. A sorter as recited in claim 1, wherein each of the receptacles is a tray for receiving sheets as articles to be treated.

6. A sorter as recited in claim 5, further comprising a tray carrier, arranged vertically movably, for carrying the trays therein.

7. A sorter as recited in claim 6, wherein the guide means comprises: a pin provided to the front portion of each tray; and guide groove substantially V-shaped, provided to the tray carrier, for slidably guiding the pin.

8. A sorter as recited in claim 5, wherein the treatment applying means comprises a stapler for stapling the articles to be treated.

9. A sorter as recited in claim 8, further comprising a vertically movable tray carrier for carrying the trays therein.

10. A sorter as recited in claim 9, wherein the guide means comprises: a pin provided to the front portion of each tray; and guide groove substantially V-shaped, provided to the tray carrier, for slidably guiding the pin.

* * * * *